United States Patent [19]

Tam et al.

[11] Patent Number: 4,883,731

[45] Date of Patent: Nov. 28, 1989

[54] IMAGING SYSTEM

[75] Inventors: Man C. Tam, Mississaugua; Arnold L. Pundsack, Georgetown, both of Canada

[73] Assignee: Xerox Corporation, Stamford, Conn.

[21] Appl. No.: 141,011

[22] Filed: Jan. 4, 1988

[51] Int. Cl.[4] ..... G03G 13/22

[52] U.S. Cl. ..... 430/41

[58] Field of Search ..... 430/41

[56] References Cited

U.S. PATENT DOCUMENTS

| | | | |
|---|---|---|---|
| 2,576,047 | 11/1951 | Schaffert . | |
| 3,574,614 | 4/1971 | Carreira | 96/1.4 |
| 3,765,330 | 10/1973 | Gundlack | 101/426 |
| 3,837,851 | 9/1974 | Shattuck et al. | 430/59 |
| 3,909,262 | 9/1975 | Goffe et al. | 96/1.5 |
| 3,967,818 | 7/1976 | Gundlack | 270/18 |
| 3,967,959 | 7/1976 | Goffe et al. | 430/41 |
| 3,972,717 | 8/1976 | Wiedemann | 430/65 |
| 3,975,195 | 8/1976 | Goffe | 96/1 PS |
| 4,081,274 | 3/1978 | Horgan | 430/59 |
| 4,256,821 | 3/1981 | Enomoto et al. | 430/59 |
| 4,338,388 | 7/1982 | Sakai et al. | 430/59 |
| 4,407,918 | 10/1983 | Sato | 430/54 |
| 4,518,668 | 5/1985 | Nakayama | 430/49 |
| 4,520,089 | 5/1985 | Tazuki et al. | 430/49 |
| 4,533,611 | 8/1985 | Winkelmann et al. | 430/49 |
| 4,536,457 | 8/1985 | Tam | 430/41 |
| 4,536,458 | 8/1985 | Ng | 430/41 |
| 4,584,253 | 4/1986 | Lin et al. | 430/66 X |

*Primary Examiner*—Paul R. Michl
*Assistant Examiner*—Jeffrey A. Lindeman
*Attorney, Agent, or Firm*—Peter H. Kondo; Judith L. Byorick

[57] ABSTRACT

An imaging system in which an imaging member comprising a substrate and an electrically insulating softenable layer on the substrate, the softenable layer comprising migration marking material locked at least at or near the surface of the softenable layer spaced from the substrate, and a charge transport material in the softenable layer is imaged by electrostatically charging the member, exposing the member to activating radiation in an imagewise pattern, and decreasing the resistance to migration of marking material in the softenable layer sufficiently to allow the migration marking material struck by activating radiation to substantially migrate in depth towards the substrate in image configuration. This imaged member may be used as a xeroprinting master in a xeroprinting process comprising uniformly charging the master, uniformly exposing the charged master to activating illumination to form an electrostatic latent image, developing the latent image to form a toner image and transfering the toner image to a receiving member. A charge transport spacing layer comprising a film forming binder and a charge transport compound may be employed between the substrate and the softenable layer in order to increase the contrast potential associated with the surface changes of the latent image.

18 Claims, 6 Drawing Sheets

IMAGING SYSTEM

BACKGROUND OF THE INVENTION

This invention relates generally to an imaging system, and more specifically to an improved migration imaging member and xeroprinting duplicating process utilizing the improved migration imaging member.

In the art of printing/duplicating, various techniques have been developed for preparing masters for subsequent use in printing processes. For example, lithographic or offset printing is a well known and established printing process. In general, lithography is a method of printing from a printing plate which depends upon different properties of the imaged and non-imaged areas for printability. In conventional lithography, a lithographic intermediate is first prepared on silver halide film from the original; the printing plate is then contact exposed by intense UV light through the intermediate. UV exposure causes the exposed area of the printing plate to become hydrophilic or ink receptive; the non-exposed area is washed away by chemical treatment and becomes hydrophobic or ink repellant. Printing ink is then applied to the printing plate and the ink image is transferred to an offset roller where the actual printing takes place. Although lithographic printing provides high quality prints and high printing speed, the processes require the use of expensive intermediate films and printing plates. Additionally, considerable cost and time are consumed in their preparation, often requiring highly skilled labor and strict control measures. A further disadvantage is the difficulty in setting up the printing press to achieve the proper water to ink balance required to produce the desired results during the printing process. This results in further increased cost and delay time in obtaining the first acceptable print.

The above mentioned problems become especially severe in the manufacture of high quality color prints when several color separation images must be superimposed on the same receiving medium. Because of the high cost and complexities associated with the preparations of expensive printing plates and press runs, color proofing is employed to form representative interim prints (called proofs) from color separation components to allow the end user to determine whether the finished prints faithfully reproduce the desired results. As is often the case, the separation components may require repeated alteration to satisfy the end user. Only when the end user is satisfied with the results, a printing plate associated with each separation component is prepared and ultimately employed in the press run. An example of a color proofing system is the CROMALIN, introduced by E. I. duPont de Nemours & Co. in 1972 and widely used in the printing industry. It consists of a light sensitive tacky photopolymer layer laminated to paper. The photopolymer layer is contact exposed through a color separation component under a UV source. The exposed areas polymerize and lose their tackiness, while the non-exposed areas remain tacky. Toners are applied and adhere to the tacky areas. Since very different processes are employed in proofing and press runs, the proofs at best can only simulate the press sheets. Additionally, preparation of the color proofs is a time consuming process (e.g. about 30 minutes per proof for CROMALIN).

Xerographic printing is another well known printing technique. In conventional xerographic printing, an electrostatic image is first produced, either by lens coupled exposure to visible light or by laser scanning, on a conventional photoreceptor; the electrostatic image is then toned, followed by transferring the toner image to a receiving medium. While it offers the advantages of ease of operation and printing stability, requiring less skilled involvement and labor cost, the combined requirements of high quality and high printing speed, as those needed in commercial printing can not be easily met simultaneously at reasonable cost. This is because, to provide high quality and avoid certain artifacts, very high-picture-element density is also required. If a new image were to be written, for example, on the photoreceptor for each print, these requirements for high speed and high density would imply electronic bandwidths and (if laser scanning were used) modulation rates and polygon rotation speeds which are very unlikely to be available at resonable cost in the foreseeable future. There is no technology likely to overcome this problem in a direct way. The problems relating to conventional xerographic duplicating and printing include the necessity to continually repeat at high speed the imagewise exposure step.

Xeroprinting is another xerographic printing method. Conceptually, xeroprinting overcomes the above problems in a very simple way. Xeroprinting is an electrostatic printing process for printing multiple copies from a master plate or cylinder. The master plate may comprise a metal sheet upon which is imprinted an image in the form of a thin electrically insulating coating. The master plate may be made by photomechanical methods or by xerographic techniques. From the original, a single xeroprinting "master" can, for example, first be made slowly, in say 30–60 seconds. This imaged material is classically an electrical conductor with an imagewise pattern of insulating areas made by photomechanical or xerographic techniques; it has different charge acceptance in the imaged and non-imaged areas. Thus, generally, the imaging surface of the master plate comprises an electrically insulating pattern corresponding to the desired image shape and electrically conductive areas corresponding to the background. The xeroprinting master is then uniformly charged; the carge remains trapped only on the insulating areas, and this electrostatic image may then be toned. After toner transfer to paper and possibly cleaning, the charge-tone-transfer-clean process is repeated at high speed. In principle, then, it is possible to retain much of the simplicity, stability and quality of the xerographic process, without the need for repeated imagewise exposure. As an additional bonus, it may not be necessary to employ a cleaning step, since the same area is repeatedly toned. Moreover, conventional toners can be used, avoiding the problem of lack of color saturation which is encountered with comparable schemes employing magnetography. High contrast potential and high resolution of the electrostatic latent image are important characteristics that determine print qualities of documents prepared by xeroprinting. However these prior art xeroprinting techniques were found to produce prints of inferior quality. This is because an insulating pattern on a metal conductor cannot be fully and uniformly charged near its boundaries. As contrast potential builds up along the boundaries of the insulating pattern, fringing electric fields from the insulating image areas repel incoming ions from the charging device, which is usually a corona charging device, to the adjacent electrically conductive background areas. This results not only in low contrast potential but also in poor print resolution. Additionally, some xeroprinting processes require numerous processing steps and complex equipment to prepare the master and/or final xeroprinted product. Some xeroprinting techniques also require messy photochemical processing and removal of materials in either the image or non-image areas of the master.

In U.S. Pat. No. 3,574,614 issued to L. Carreira, a xeroprinting process is disclosed in which the xeroprinting master is formed by applying an electric field to a layer of photoelectrophoretic imaging suspension between a blocking electrode and an injecting electrode, one of which is transparent, the suspension comprising a plurality of photoelectrophoretic particles in an insulating carrier liquid, imagewise exposing the suspension to electromagnetic radiation through the transparent electrode to form complementary images on the surfaces of the electrodes (the light exposed particles migrating from the injecting electrode to the blocking electrode), transferring one of the images to a conductve substrate, uniformly applying to the image bearing substrate an organic insulating binder such that the binder thickness both within the image formed and the non-image areas ranges from 1–20 micrometers. The xeroprinting process consists of applying a uniform charge to the surface of the image bearing substrate in the presence of electromagnetic radiation to form an electrostatic residual charge pattern corresponding to the non-image areas (areas void of photoelectrophoretic particles), developing the residual charge pattern, transferring the developer from the residual charge pattern to a copy sheet and repeating the charging, developing and transferring steps. Alternatively, the insulating binder may be intimately blended with the dispersion of the photoelectrophoretic particles prior to insertion of the liquid mixture between the electrodes. The areas from which photoelectrophoretic particles have migrated become insulating and capable of supporting an electrostatic charge. A major problem is that insulating images supported directly on a conducting substrate cannot be charged close to the edges, because fringe fields drive incoming ions to the grounded substrate. Another disadvantage of such processes is that they require the use of a liquid photoelectrophoretic imaging suspension to prepare the master. Additionally master making processes are extremely complicated involving the removal of one of the electrodes, transfer of one of the complementary images to a conductive substrate, and application of an organic insulating binder to the conductive substrate. Such complicated master making processes are inconvenient to the users and can adversely affect the print quality. It also requires additional time to dry the image prior to use as a zeroprinting master.

Unlike the liquid photoelectrophoretic imaging suspension system described in U.S. Pat. No. 3,574,614, solid imaging members have been prepared for dry migration systems. Dry migration imaging members have been extensively described in the patent literature, for example, in U.S. Pat. No. 3,909,262 which issued Sept. 30, 1975 and U.S. Pat. No. 3,975,195 which issued Aug. 17, 1976, the disclosures of both being incorporated herein in their entirety. In a typical embodiment of these migration imaging systems, a migration member comprising a substrate, a layer of softenable material, and photosensitive marking material is imaged by first forming a latent image by electrically charging the member and exposing the charged member to a pattern of activating electromagnetic radiation such as light. Where the photosensitive marking material is originally in the form of a fracturable layer contiguous the upper surface of the softenable layer, the marking particles in the exposed area of the member migrate in depth toward the substrate when the member is developed by softening the softenable layer.

The expression "softenable" as used herein in intended to mean any material which can be rendered more permeable thereby enabling particles to migrate through its bulk. Conventionally, changing the permeability of such material or reducing its resistance to migration of migration marking material is accomplished by dissolving, swelling, melting or softening, by techniques, for example, such as contacting with heat, vapors, partial solvents, solvent vapors, solvents and combinations thereof, or by otherwise reducing the viscosity of the softenable material by any suitable means.

The expression "fracturable" layer or material as used herein, means any layer or material which is capable of breaking up during development, thereby permitting portions of said layer to migrate toward the substrate or to be otherwise removed. The fracturable layer is preferably particulate in the various embodiments of the migration imaging members. Such fracturable layers of marking material are typically contiguous to the surface of the softenable layer spaced apart from the substrate, and such fracturable layers may be substantially or wholly embedded in the softenable layer in various embodiments of the imaging members.

The expression "contiguous" as used herein is intended to mean in actual contact, touching, also near, though not in contact, and adjoining, and is intended to generically describe the relationship of the fracturable layer of marking material in the softenable layer, vis-a-vis, the surface of the softenable layer spaced apart from the substrate.

The expression "optically sign-retained" as used herein is intended to mean that the dark (higher optical density) and light (low optical density) areas of the visible image formed on the migration imaging member correspond to the dark and light areas of the image on the original.

The expression "optically sign-reversed" as used herein is intended to mean that the dark areas of the image formed on the migration imaging member correspond to the light areas of the image on the original and the light areas of the image formed on the migration imaging member correspond to the dark areas of the image on the original.

The expression "optical contrast density" as used herein is intended to mean the difference between maximum optical density ($D_{max}$) and minimum optical density ($D_{min}$) of an image. Optical density is measured for the purpose of this application by diffuse densitometers with a blue Wratten No. 94 filter. The expression "optical density" as used herein is intended to mean "transmission optical density" and is represented by the formula:

$$D=\log_{10}[I_o/I]$$

where I is the transmitted light intensity and $I_o$ is the incident light intensity. For the purpose of this invention, all value of transmission optical density given in this invention include the substrate density of about 0.2 which is the typical density of a metallized polyester substrate.

There are various other systems for forming such images, where non-photosensitive or inert marking materials are arranged in the aforementioned fracturable layers, or dispersed throughout the softenable layer, as described in the aforementioned patent, which also discloses a variety of methods which may be used to form latent images upon migration imaging members.

Various means for developing the latent images may be used for migration imaging systems. These development methods include solvent wash away, solvent vapor softening, heat softening, and combinations of these methods, as well as any other method which changes the resistance of the softenable material to the migration of particulate marking material through the softenable layer to allow imagewise migration of the particles in depth toward the substrate. In the solvent wash away or meniscus development method, the migration marking material in the light struck region migrates toward the substrate through the softenable layer, which is softened and dissolved, and repacks into a more or less monolayer configuration. In migration imaging films supported by transparent substrates alone, this region exhibits a maximum optical density which can be high as the initial optical density of the unprocessed film. On the other hand, the migration marking material inthe unexposed region is substantially washed away and this region exhibits a minimum optical density which is essentially the optical density of the substrate alone. Therefore the image sense of the developed image is sign reversed, i.e. positive to negative or vice versa. Various methods and materials and combinations thereof have previously been used to fix such unfixed migration images. In the heat, or vapor softening developing modes, the migration marking material in the light struck region disperses in the depth of the softenable layer after development and this region exhibits $D_{min}$ which is typically in the range of 0.6–0.7. This relatively high $D_{min}$ is a direct consequence of the depthwise dispersion of the otherwise unchanged migration marking material. On the other hand, the migration marking material in the unexposed region does not migrate and substantially remains in the original configuration, i.e. a monolayer. In migration imaging films supported by transparent substrates, this region exhibits a maximum optical density ($D_{max}$) of about 1.8–1.9. Therefore, the image sense of the heat or vapor developed images is sign retaining, i.e. positive-to-positive or negative-to-negative.

Techniques have been devised to permit optically sign-reversed imaging with vapor development, but these techniques are generally complex and require critically controlled processing conditions. An example of such techniques can be found in U.S. Pat. No. 3,795,512.

For many imaging applications, it is desirable to produce negative images from a positive original or positive images from a negative original i.e. optically sign-reversing imaging, preferably with low minimum optical density. Although the meniscus or solvent wash away development method produces optically sign-reversed images with low minimum optical density, it involves removal of materials from the migration imaging member, leaving the migration image largely or totally unprotected from abrasion. Although various methods and materials have previously been used to overcoat such unfixed migration images, the post-development overcoating step is impractically costly and inconvenient for the end users. Additionally, disposal of the effluents washed from the migration imaging member during development is also very costly.

The background portions of an imaged member may sometimes be transparentized by means of an agglomeration and coalescence effect. In this system, an imaging member comprising a softenable layer containing a fracturable layer of electrically photosensitive migration marking material is imaged in one process mode by electrostatically charging the member, exposing the member to an imagewise pattern of activating electromagnetic radiation, and the softenable layer softened by exposure for a few seconds to a solvent vapor thereby causing a selective migration in depth of the migration material in the softenable layer in the areas which were previously exposed to the activating radiation. The vapor developed image is then subjected to a heating step. Since the exposed particles gain a substantial net charge (typically 85–90% of the deposited surface charge) as a result of light exposure, they migrate substantially in depth in the softenable layer towards the substrate when exposed to a solvent vapor, thus causing a drastic reduction in optical density. The optical density in this region is typically in the region of 0.7 to 0.9 (including the substrate density of about 0.2) after vapor exposure, compared with an initial value of 1.8 to 1.9 (including the substrate density of about 0.2). In the unexposed region, the surface charge becomes discharged due to vapor exposure. The subsequent heating step causes the unmigrated, uncharged migration material in unexposed areas to agglomerate or flocculate, often accompanied by coalescence of the marking material particles, thereby resulting in a migration image of very low minimum optical density (in the unexposed areas) in the 0.25–0.35 range. Thus the contrast density of the final image is typically in the range of 0.35 to 0.65. Alternatively, the migration image may be formed by heat followed by exposure to solvent vapors and a second heating step which also results in a migration image with very low minimum optical density. In this imaging system as well as in the previously described heat or vapor development techniques, the softenable layer remains substantially intact after development, with the image being self-fixed because the marking material particles are trapped within the softenable layer.

The word "agglomeration" as used herein is defined as the coming together and adhering of previously substantially separate particles, without the loss of identity of the particles.

The word "coalescence" as used herein is defined as the fusing together of such particles into larger units, usually accompanied by a change of shape of the agglomerate towards a shape of lower energy, such as a sphere.

Generally, the softenable layer of migration imaging members is characterized by sensitivity to abrasion and foreign contaminants. Since a fracturable layer is located at or close to the surface of the softenable layer, abrasion can readily remove some of the fracturable layer during either manufacturing or use of the film and adversely affect the final image. Foreign contamination such as finger prints can also cause defects to appear in any final image. Moreover, the softenable layer tends to cause blocking of migration imaging members when multiple members are stacked or when the migration imaging material is wound into rolls for storage or transportation. Blocking is the adhesion of adjacent objects to each other. Blocking usually results in damage to the objects when they are separated.

The sensitivity to abrasion and foreign contaminants can be reduced by forming an overcoating such as the overcoatings described in U.S. Pat. No. 3,909,262. However, because the migration imaging mechanisms for each development method are different and because they depend critically on the electrical properties of the surface of the softenable layer and on the complex interplay of the various electrical processes involving charge injection from the surface, charge transport through the softenable layer, charge capture by the photosensitive particles and charge ejection from the photosensitive particles etc., application of an overcoat to the softenable layer often causes changes in the delicate balance of these processes, and results in degraded photographic characteristics compared with the non-overcoated migration imaging member. Notably, the photographic contrast density is degraded. Recently, improvements in migration imaging members and processes for forming images on these migration imaging members have been achieved. These improved migration imaging members and processes are described in U.S. Pat. No. 4,536,458 issued to Dominic S. Ng and U.S. Pat. No. 4,536,457 issued to Man C. Tam.

PRIOR ART STATEMENT

U.S. Pat. No. 3,574,614 to L. Carreira, issued April 13, 1971,—A process is disclosed in which a layer of photoelectrophoretic imaging suspension is subjected to an applied electric field between a blocking electrode and an injecting electrode, one of which is transparent, the suspension comprising a plurality of photoelectrophoretic particles in an insulating carrier liquid, imagewise exposing the suspension to electromagnetic radiation through the transparent electrode to form complementary images on the surfaces of the electrodes (the light exposed particles migrating form the injecting electrode to the blocking electrode), transferring one of the images to a conductive substrate, uniformly applying to the image bearing substrate an organic insulating binder such that the binder thickness both within the image formed and the non-image areas ranges from 1-20 micrometers, applying a uniform charge to the surface of the image bearing substrate in the presence of electromagnetic radiation to form an electrostatic residual charge pattern corresponding to the non-image areas (areas void of photoelectrophoretic particles), developing the residual charge pattern, transferring the developer from the residual charge pattern to a copy sheet and repeating the charging, developing and transferring steps. Alternatively, the insulating binder may be intimately blended with the dispersion of the photoelectrophoretic particles prior to insertion of the liquid mixture between the electrodes. The areas from which photoelectrophoretic particles have migrated become insulating and capable of supporting an electrostatic charge.

U.S. Pat. No. 4,536,458 to Dominic S. Ng, issued August, 20, 1985—A migration imaging member is disclosed comprising a substrate and an electrically insulating softenable layer on the substrate, the softenable layer comprising migration marking material located at least at or near the surface of the softenable layer spaced from the substrate and a charge transport molecule. The migration imaging member is electrostatically charged, exposed to activating radiation in an imagewise pattern and developed by decreasing the resistance to migration, by exposure either to solvent vapor or heat, of marking material in depth in the softenable layer at least sufficient to allow migration of marking material whereby marking material migrates toward the substrate in image configuration. The preferred thickness of the softenable layer is about 0.7-2.5 micrometers, although thinner and thicker layers may also be utilized.

U.S. Pat. No. 4,536,457 to M. C. Tam, issued August 20, 1985—A process is disclosed in which a migration imaging member comprising a substrate and an electrically insulating softenable layer on the substrate, the softenable layer comprising migration marking material located at least at or near the surface of the softenable layer spaced from the substrate and a charge transport molecule, (e.g. the imaging member described in U.S. Pat. No. 4,536,458), is uniformly charged, and exposed to activating radiation in an imagewise pattern. The resistance to migration of marking material in the softenable layer is thereafter decreased sufficiently by the application of solvent vapor to allow the light exposed particles to retain a slight net charge to prevent agglomeration and coalescence and to allow slight migration in depth of marking material towards the substrate in image configuration, and the resistance to migration of marking material in the softenable layer is further decreased sufficiently by heating to allow non-exposed marking material to agglomerate and coalesce. The preferred thickness is about 0.5-2.5 micrometer, although thinner and thicker layers may be utilized.

U.S. Pat. No. 2,576,047 to R. Schaffert, issued November 20, 1951—A xeroprinting device and process are described in which, for example, an insulating pattern in image configuration coated on a metal drum is electrostatically charged and thereafter developed with developer powder. The resulting powder image on the insulating pattern is electrostatically transferred to a receiving member. The insulating pattern is cleaned and recycled.

U.S. Pat. No. 3,967,818 to R. Gundlach, issued July 6, 1976—A duplicating system for producing collated copy sets for precollated information is disclosed. A xeroprinting master may be utilized as a master scroll that can move in reverse directions. The master is electrostatically charged and developed and the resulting toner image is transferred to a receiving member.

U.S. Pat. No. 3,765,330 to R. Gundlach, issued October 16, 1973—A xeroprinting system is disclosed which utilizes a printing member comprising a conductive substrate having raised and recessed areas of the same material and a layer of electrically resistive material contacting the relief areas and spanning without touching the recessed areas. A uniform charge is applied to the printing member to form discharged areas where the resistive material contacts the relief areas and charged areas where the resistive material spans the recessed areas. The printing member is then developed and the developed image is electrostatically transferred to a transfer sheet.

U.S. Pat. No. 4,407,918 to E. Sato, issued October 4, 1983—Electrophotographic processes and apparatus are disclosed for preparing plural copies from a single image. A photosensitive member is described which includes an electrically conductive substrate, a first photoconductive layer applied on the substrate, a charge retentive insulating layer applied on the first photoconductive layer and a second conductive layer applied on the charge retentive layer. The photosensitive member is uniformly charged to a negative polarity and exposed to visible light. An image of a document to be copied is projected while the photosensitive member is positively charged. The photosensitive member is then exposed to visible and ultraviolet light, thereby trapping latent charged images across the charge retentive layer.

U.S. Pat. No. 4,518,668 to Nakayama, issued May 21, 1985—A method is disclosed for preparing a lithographic printing plate. A light sensitive material comprising a light sensitive layer and a photoconductive insulating layer is imagewise exposed and processed to form an electrostatic latent image on the photoconductive insulating layer. The image is then developed by charged opaque developer particles. This developed image is then used for contact exposure of the underlying light sensitive lithographic master layer.

U.S. Pat. No. 4,520,089 to Tazuki et al, issued May 28, 1985—An electrophotographic offset master is disclosed comprising a base paper, one side of which is provided with a back coat layer made of sericite. Another side of the base paper is provided with a precoat layer of a photoconductor and an adhesive. The master is prepared by imagewise exposure of the photoconductor followed by subsequent development and fixation thereof.

U.S. Pat. No. 4,533,611 to Winkelmann et al, issued August 6, 1985—A process for preparing a planographic printing plate is disclosed in which a charged image is produced on a photoconductive layer and dielectric film applied thereon. The image is then developed and transferred to the printing plate.

There are many disadvantages associated with these prior art techniques. For example, some prior art xeroprinting techniques produce poor quality prints because of their poor resolution capabilities caused by fringing electric fields as explained above. Some xeroprinting processes require numerous processing steps and complex equipment to prepare the master and/or final xeroprinted product. Messy photochemical processing and removal of materials in either the image or non-image areas of the master are also required for some xeroprinting techniques. In some approaches an insulating image is formed on a "leaky" dielectric; that is, a substrate that will accept and retain charge for a time longer than the time charges are applied to each particular spot, but that discharges over a relaxation time shorter than the time between charging and developing the latent image. The fundamental problem in that approach is that most resistive ("leaky") dielectric films are sensitive to relative humidity, and sometimes to age and temperature, as well. That is the relaxation time varies beyond acceptable tolerance limits, over the normally encountered range of relative humidity, temperature, and product life. These shortcomings are particularly detrimental for color printing/duplicating applications which require high quality, high resolution and high speed.

In recent years, the use of computer technology has become increasingly widespread in the commercial printing industry. While this has resulted in greatly increased efficiency and productivity of the printing process, the benefits of computer technoogy have mostly been confined to the prepress operations such as text editing, composition, pagination and the like. In order to provide the high quality, high resolution and high printing speed, the dominant printing process is still off-set lithography which is not compatible with computer technology because of the very low photosensitivity of conventional printing plates. Other printing technologies such as laser xerography, thermal printing, ionography, magnetography and the like are compatible with computer technology, but they can not satisfy the combined requirements of high quality, high resolution and high throughput speed, as explained above.

Therefore, there continues to be a need for improved imaging members and improved processes of xeroprinting.

SUMMARY OF THE INVENTION

It is an object of the present invention to provide a novel and improved imaging system which overcomes the above-noted disadvantages.

It is yet another object of the present invention to provide an improved imaging system which has the combined advantages of producing high quality, high resolution prints at high throughput speed, is compatible with computer technology, and is suitable for both color proofing and printing/duplicating applications.

It is yet another object of the present invention to provide an improved imaging system which eliminates the complex, expensive and time consuming procedures heretofore generally accepted as necessary in the art of printing/duplicating.

It is yet another object of the present invention to provide a novel and improved xeroprinting master precursor which exhibits the photodischarge characteristics of a conventional photoreceptor, possesses high photosensitivity and can be imaged by electronic means such as laser scanning in the peparation of the xeroprinting master.

It is yet another object of the present invention to provide a novel and improved master making process which can be a totally dry process requiring only simple processing steps, is accomplished in a short time, requires no addition or removal of material, has wide processing latitude, and produces excellent optically sign-retaining, high resolution visible images on the xeroprinting master.

It is yet another object of the present invention to provide a novel and improved xeroprinting master which possesses excellent visible, optically sign-retaining high resolution images, have greatly different photo discharge characteristics in the $D_{max}$ and $D_{min}$ areas, is electrically insulating over the entire imaging surface, can be uniformly electrically charged to its full potential and with sufficient photosensitivity in $D_{max}$ areas, so that upon subsequent uniform light exposure substantially discharges the $D_{max}$ areas to produce excellent electrostatic latent images having high contrast potential and high resolution; in addition to being useful as a xeroprinting master, the xeroprinting master of the present invention is also useful as lithographic intermediates in the production of conventional printing plates for offset printing.

It is another object of the present invention to provide a simple xeroprinting process of using a novel and improved xeroprinting master capable of producing high quality, high resolution prints and at high speed on a receiving member.

It is another object of the present invention to provide a simple xeroprinting process which is capable of stable cyclic performance over thousands of imaging cycles.

It is another object of the present invention to provide a simple xeroprinting process which is capable of being overcoated to yield a surface relatively inert to contamination or deterioratin by contact with common liquid developer materials.

The imaged member of this invention may be prepared by providing a migration imaging member comprising a substrate and an electrically insulating softenable layer on the substrate, the softenable layer comprising a charge transport molecule and a fracturable layer of electrically photosensitive migration marking material located substantially at or near the surface of the softenable layer spaced from the substrate; the softenable layer having a thickness of between about 3 micrometer and about 30 micrometers, the charge transport molecule being capable of increasing charge injection from the electrically photosensitive migration marking material to the softenable layer, being capable of transporting charge to the substrate and being dissolved or molecularly dispersed in the softenable layer; electrostatically charging the member to deposit a uniform charge on the member; exposing the member to activating radiation in an imagewise pattern prior to substantial decay of the uniform charge whereby the electrically photosensitive migration marking material struck by the activating radiation photogenerates charge carriers; decreasing the resistance to migration of migration marking material in the softenable layer sufficiently to allow the exposed migration marking material to migrate toward the substrate in image configuration and disperse in depth of the softenable layer.

The imaged member of this invention comprises a substrate, and an electrically insulating softenable layer having an imaging surface, an intermediate layer comprising an adhesive layer, a charge transport spacing layer comprising an electrically insulating film forming binder or a combination of the adhesive layer and the charge transport spacing layer, overlying the substrate, the electrically insulating softenable layer comprising charge transport molecules and in at least one region of the electrically insulating layer a fracturable layer of closely spaced electrically photosensitive migration marking particles in an imagewise pattern located substantially at or near the imaging surface of the electrically insulating layer, the imagewise pattern exhibiting substantial photodischarge when electrostatically charged and exposed to activating electromagnetic radiation in the spectral region in which the migration marking particles photogenerate charge carriers and being substantially absorbing and opaque to activating electromagnetic radiation in the spectral region in which the migration marking particles photogenerate charge carriers, and in at least one other region of the electrically insulating softenable layer depthwise migrated and dispersed electrically photosensitive migration marking particles located substantially within the electrically softenable insulating layer in a pattern adjacent to and complementary with the imagewise pattern of the closely spaced electrically photosensitive migration marking particles, the size of the depthwise migrated and dispersed electrically photosensitive migration marking particles being of substantially the same size as those particles in the adjacent imagewise pattern of the closely spaced electrically photosensitive migration marking particles, the pattern of the depthwise migrated and dispersed migration marking particles exhibiting substantially less photo discharge when electrostatically charged and exposed to activating electromagnetic radiation in the spectral region in which the migration marking particles photogenerate charge carriers, and being substantially less absorbing to activating electromagnetic radiation in the spectral region in which the migration marking particles photogenerate charge carriers, compared with that of the adjacent imagewise pattern of the closely spaced electrically photosensitive migration marking particles, the charge transport molecule being capable of increasing charge injection from the electricaly photosensitive migration marking material to the electrically insulating layer, being capable of transporting charge to the substrate and being dissolved or molecularly dispersed in the softenable layer and charge transport spacing layer.

This imaged member can be used as a xeroprinting master in an imaging process comprising depositing a uniform electrostatic charge on the entire imaging surface of the xeroprinting master; uniformly exposing the electrically insulating layer to activating electromagnetic radiation prior to substantial decay of the uniform electrostatic charge to substantially discharge the imaging surface overlying the imagewise pattern of the closely spaced ($D_{max}$) electrically photosensitive migration marking particles and to form an electrostatic latent image on the areas of the imaging surface overlying the complementary pattern of the layer of depthwise migrated and dispersed ($D_{min}$) electrically photosensitive migration marking particles; developing the imaging surface with electrostatically attractable toner particles to form a toner image corresponding to the imagewise pattern or the complementary pattern; and transferring the toner image to a receiving member.

BRIEF DESCRIPTION OF THE DRAWINGS

For a better understanding of the present invention, and further features thereof, reference is made to the following detailed description of various preferred embodiments wherein.

The Figures merely schematically illustrate the invention and are not intended to indicate relative size and dimensions of actual imaging members or components thereof.

DESCRIPTION OF THE PREFERRED EMBODIMENTS

Figure 1:
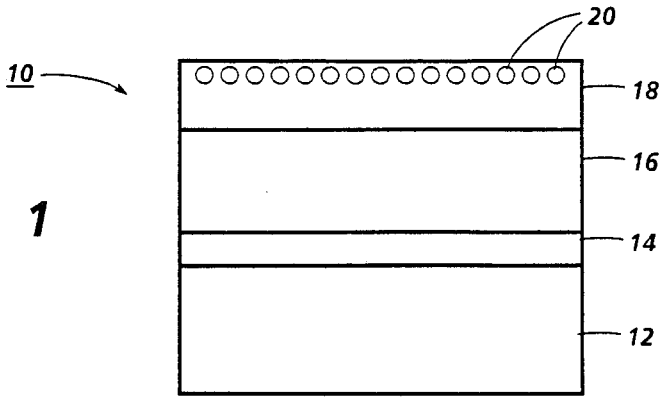
FIG. 1 is a partially schematic, cross-sectional view of one embodiment of a layered xeroprinting master precursor member.

Xeroprinting master precursor members typically suitable for use in the xeroprinting processes described above are illustrated in FIGS. 1, 2 and 3. In FIG. 1, the xeroprinting master precursor member 10 comprises substrate 12 having an optional conductive layer 14, an optional charge transport spacing layer 16 comprising a film forming polymer and a charge transport material, and a softenable layer 18 coated thereon, softenable layer 18 comprising a charge transport material and fracturable layer of migration marking material 20 contiguous with the upper surface of softenable layer 18. The particles of marking material 20 appear to be in contact with each other in the Figures due to the physical limitations of such schematic illustrations. However, the particles of marking material 20 are actually spaced less than a micrometer apart from each other. In the various embodiments, the supporting substrate 12 may be either electrically insulating or electrically conductive. For example, the supporting substrate 12 may be an electrically conductive metal drum or plate. In some embodiments the electrically conductive substrate may comprise a supporting substrate 12 having a conductive coating 14 coated onto the surface of the supporting substrate, e.g. an aluminized polyester film, upon which the optional charge transport spacing layer 16 or softenable layer 18 is also coated. The substrate 12 may be opaque, translucent, or transparent in various embodiments, including embodiments wherein the electrically conductive layer 14 coated thereon may itself be partially or substantially transparent. The fracturable layer of marking material 20 contiguous the upper surface of the softenable layer 18 may be slightly, partially, substantially or entirely embedded in the softenable material at the upper surface of the softenable layer 18.

Figure 2:
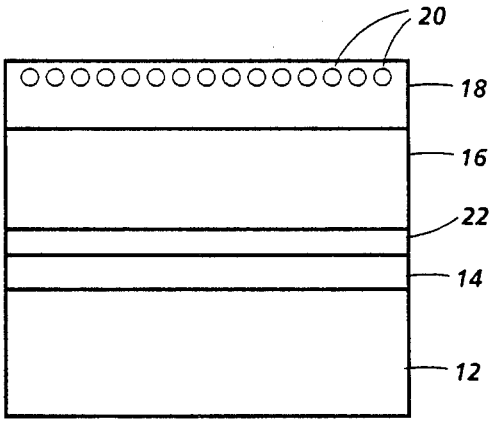
FIG. 2 is a partially schematic, cross-sectional view of another embodiment of a layered xeroprinting master precursor member.

In FIG. 2, another multi-layered embodiment of a xeroprintng master precursor member is shown wherein supporting substrate 12 has conductive coating 14, optional adhesive layer 22, optional charge transport layer 16 and softenable layer 18 coated thereon. The migration marking material 20 is initially arranged in a fracturable layer contiguous the upper surface of softenable material layer 18.

Figure 3:
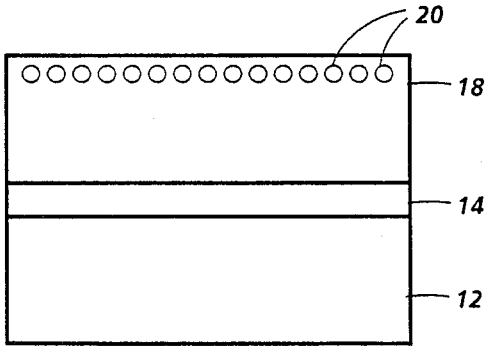
FIG. 3 is a partially schematic, cross-sectional view of still another embodiment of a layered xeroprinting master precursor member.

In the embodiment illustrated in FIG. 3, a xeroprinting master precursor member merely comprises a supporting substrate 12, a conductive layer 14 and coated softenable layer 18. The migration marking material 20 is initially arranged in a fracturable layer contiguous the upper surface of softenable material layer 18.

Although not illustrated, the embodiments illustrated in FIGS. 1 2 and 3 may also include an optional overcoating layer which is coated over the softenable layer 18. In the various embodiments of the novel xeroprinting master of this invention, the overcoating layer may comprise an abhesive or release material or may comprise a plurality of layers in which the outer layer comprises an abhesive or release material.

Figure 4:
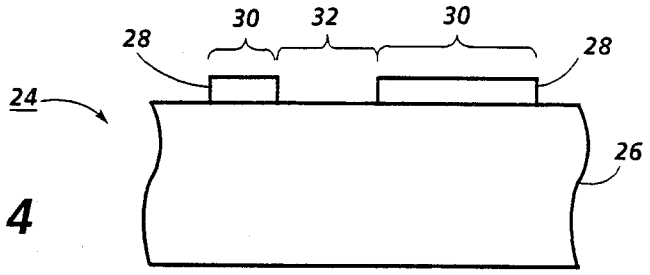
FIG. 4 is a partially schematic, cross-sectional view of a conventional xeroprinting master.

The xeroprinting master precursor members illustrated in FIGS. 1, 2 and 3 are considerably different from conventional xeroprinting master precursor members in the way that they are structured, prepared and used. For example, a typical prior art xeroprinting master is often prepared by removing materials from the non-imaged area by photomechanical techniques. Referring to FIG. 4, this imaged master 24 is classically an electrical conductor 26 with an imagewise pattern of insulating material 28 made by photomechanical or xerographic techniques. It has different charge acceptance in the insulating imaged areas 30 and electrically conductive non-imaged areas 32.

Figure 5:
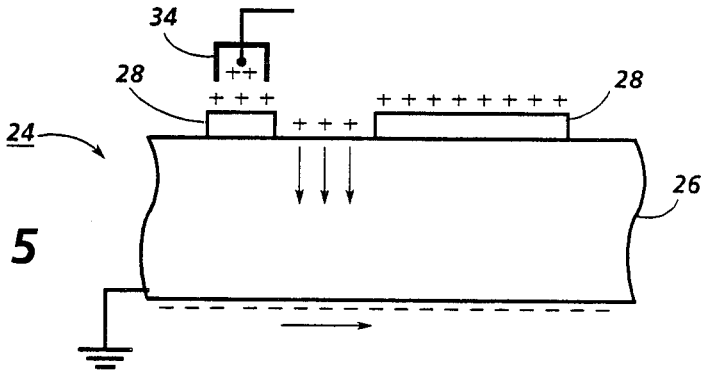
FIG. 5 is partially schematic, cross-sectional view of a conventional xeroprinting master receiving an electrostatic charge.
Figure 6:
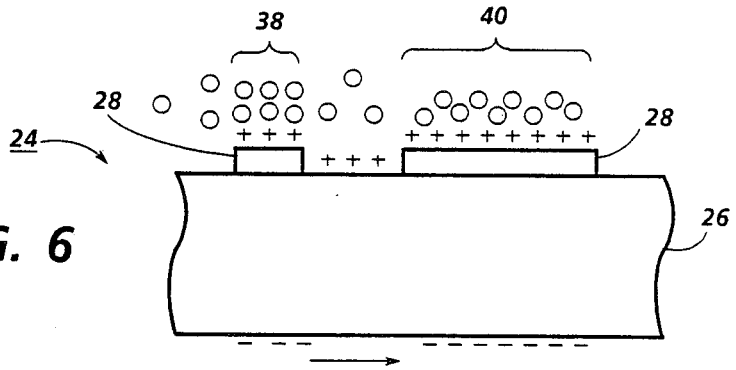
FIG. 6 is a partially schematic, cross-sectional view of a cnventional xeroprinting master being developed.

As shown in FIG. 5 the xeroprinting master 24 is then charged by means of a suitable device such as a corotron 34. The sharp boundary between the insulating image areas and the conducting background areas produces strong fringe fields as charges build upon the insulating image surface, deflecting further ions to the conducting background and preventing high charge density to the boundary. This gives fuzzy, low density fine lines as well as indistinct, low density edges of large solid areas. The deposited charge remains trapped only on the imagewise pattern of insulating material 28. In some prior art cases the non-image areas were covered with a resistive films having a charge relaxation time constant longer than the corona charging time, but shorter than the time between charging and development. The difficulty with that approach is that process latitudes are small, and variations in relaxation time contents might be severe from batch to batch, or at the range of relative humidities normally encountered, or even with aging. This electrostatic image may then be toned by conventional xerographic development techniques which transports toner particles charged to a polarity opposite the polarity of charge on the imagewise pattern of insulating material 28 thereby forming deposited toner images 38 and 40 as illustrated in FIG. 6.

Figure 7:
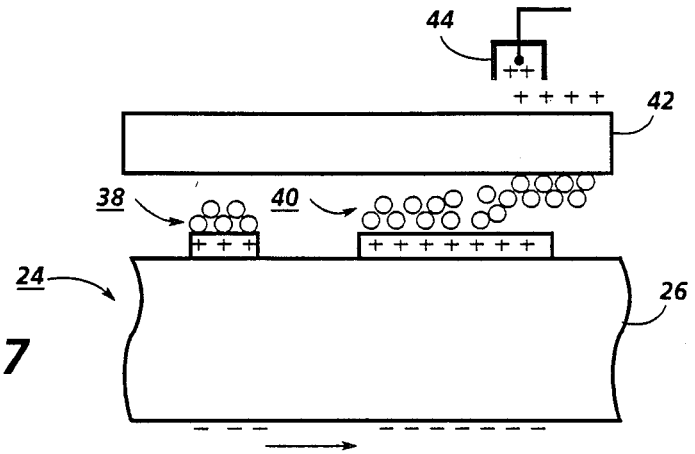
FIG. 7 is a partially schematic, cross-sectional view of a conventional xeroprinting master from which a toner image is being transferred to a receiving member.

Referring to FIG. 7, the deposited toner images 38 and 40 are transferred from imaged master 24 to a suitable receiving sheet 42, e.g. paper, by applying a uniform charge to the rear surface of receiving sheet 42 by means of a suitable charging device such as corotron 44. Following toner image transfer to receiving sheet 42, the transferred toner image may be fixed by well known techniques such as fusing, laminating and the like. The upper surfaces of electrical conductor 26 and imagewise pattern of insulating material 28 may thereafter be cleaned, if desired. The charging, toning, transfering, and cleaning steps are repeated at high speed. In principle, it is possible to retain much of the simplicity, stability and quality of the xerographic process, without the need for repeated image exposure. As an additional bonus, it may not be necessary to employ a cleaning step, since the same area is repeatedly toned. Moreover, conventional toners can be used, avoiding the problem of lack of color saturation which is encountered with comparable schemes employing, for example, magnetography.

Figure 8:
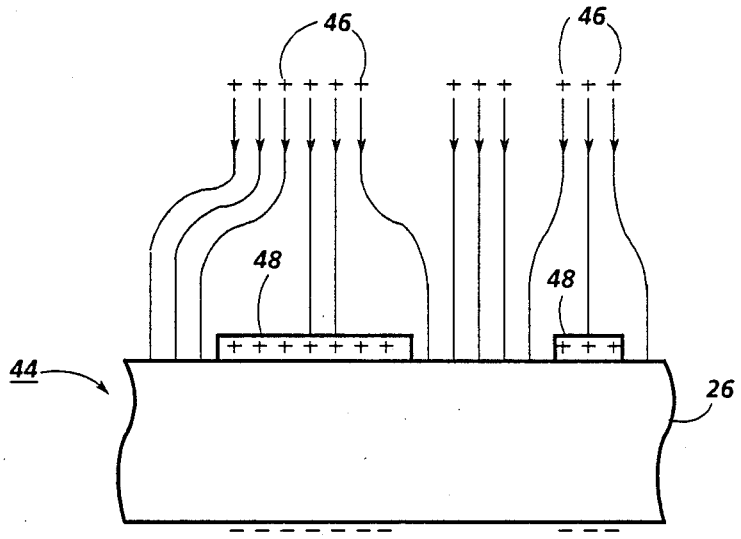
FIG. 8 is a partially schematic, cross-sectional view of a conventional xeroprinting master receiving an electrostatic charge to illustrate the effects of fringing electric field.

Notwithstanding its conceptual simplicity, xeroprinting has in practice been a classical problem in electrophotographic technology. Despite much effort, dating from the early days of xerography, it has proved challenging to design a process which produces high quality prints. The problem with this xeroprinting master is that the insulator must be reasonably thick, in order for the voltage on the xeroprinting master to be high enough for good xerographic development. As shown in FIG. 8, when a xeroprinting master 44 is charged, fringing electric fields (not shown) are set up between electrical conductor 46 and imagewise pattern of insulating material 48. These fringing fields extend over significant distances and tend to deflect further incoming ions 46. The resultant nonuniform charging of imagewise pattern of insulating material 48 seriously limits the resolution of the final prints and preventsuse of the process for high quality purposes. The resolution can be improved with special techniques, but they are too critical for practical use.

Figure 9:
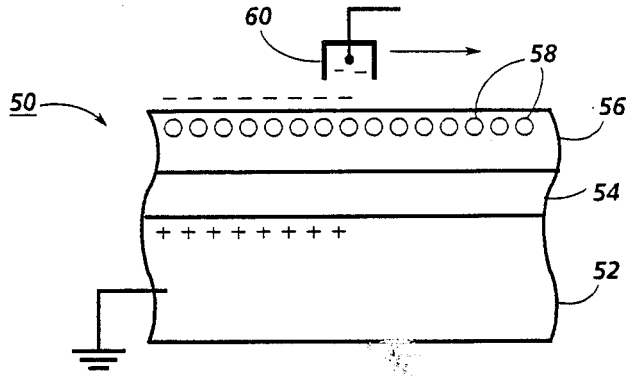
FIG. 9 is a partially schematic, cross-sectional view of a xeroprinting master precursor member of this invention receiving an electrostatic charge.
Figure 10:
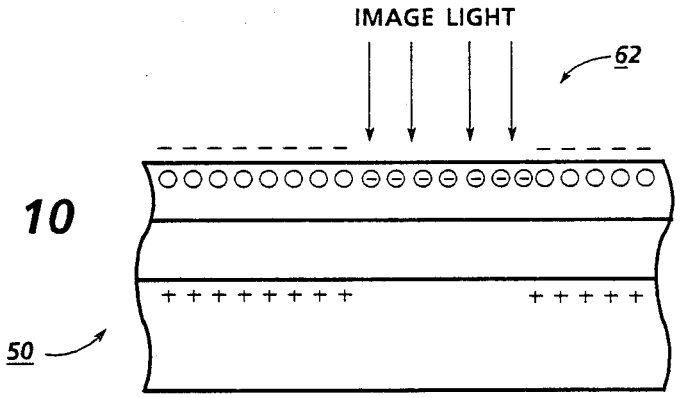
FIG. 10 is a partially schematic, cross-sectional view of a xeroprinting master precursor member of this invention being exposed to activating electromagnetic radiation in image configuration.
Figure 11:
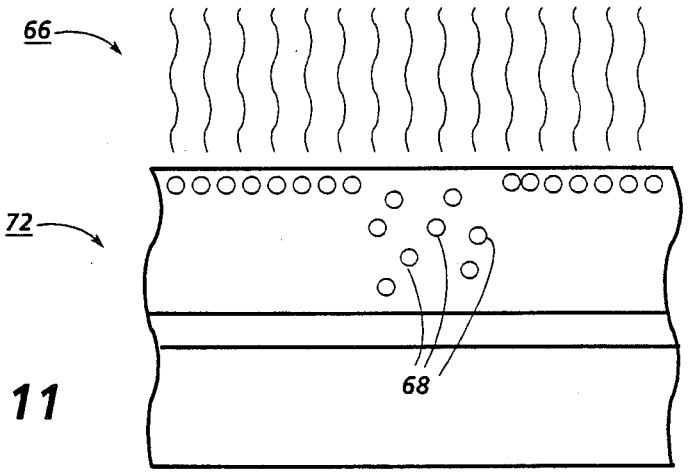
FIG. 11 is a partially schematic, cross-sectional view of a xeroprinting master precursor member of this invention being exposed to heat.

The steps for preparation of an improved xeroprinting master of this invention are shown in FIGS. 9 through 11. Referring to FIG. 9, a xeroprinting master precursor member 50 comprising an electrically grounded conductive substrate 52, charge transport layer 54, softenable layer 56 and fracturable layer of migration marking material 58 is shown as being uniformly charged negatively by means of a corona charging means 60. The uniformly charged xeroprinting master precursor member 50 is thereafter imagewise exposed to activating illumination 62 as illustrated in FIG. 10. The light exposed xeroprinting master precursor member 50 is then ready for development.

Referring to FIG. 11, upon application of heat energy 66 to the light exposed xeroprinting master precursor member, conversion of the precursor member into a xeroprinting master 72 is completed. In the light exposed areas of fracturable layer of migration marking material 58, the migration marking particles have dispersed substantially depthwise in the softenable layer by migrating toward substrate 52 to form a $D_{min}$ area. The size of the migrated marking particles remains substantially the same as the marking particles in the layer of migration marking material 58. The unexposed marking particles remain substantially in their original position to result in a $D_{max}$ area. Thus, the developed image in the final xeroprinting master 72 is an optically sign-retaining visible image of an original (if a conventional light-lens exposure system is utilized).

Figure 12:
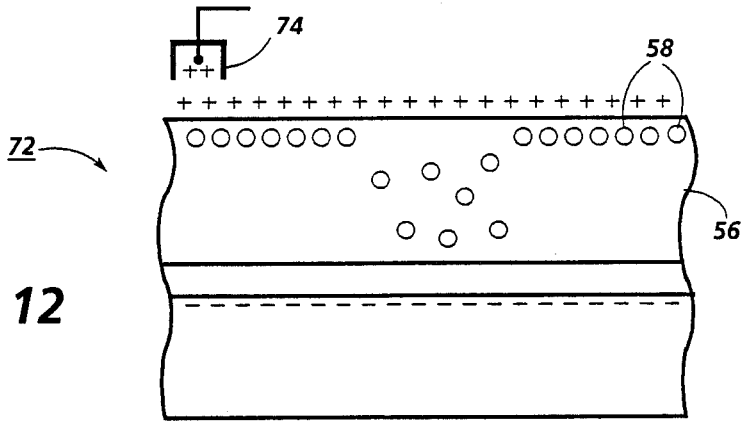
FIG. 12 is a partially schematic, cross-sectional view of a xeroprinting master of this invention receiving an electrostatic charge.
Figure 13:
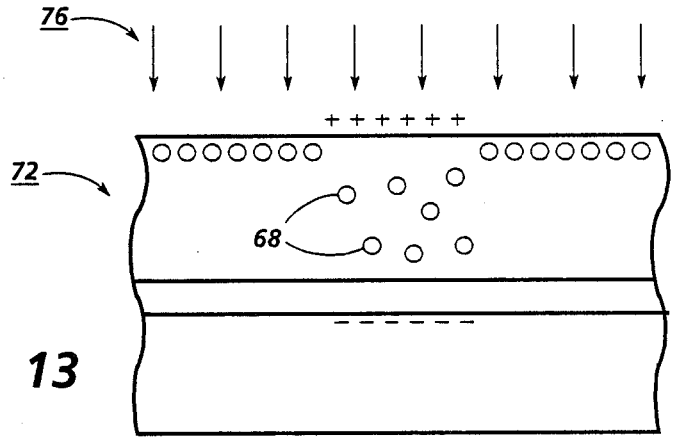
FIG. 13 is a partially schematic, cross-sectional view of a xeroprinting master of this invention being uniformly exposed to activating electromagnetic radiation.
Figure 14:
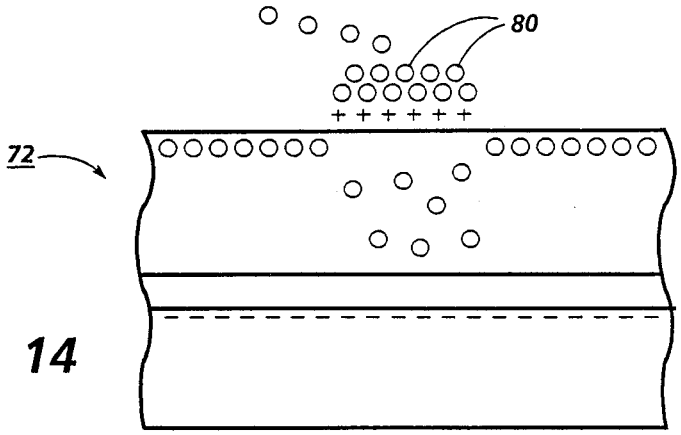
FIG. 14 is a partially schematic, cross-sectional view of a xeroprinting master of this invention being developed.
Figure 15:
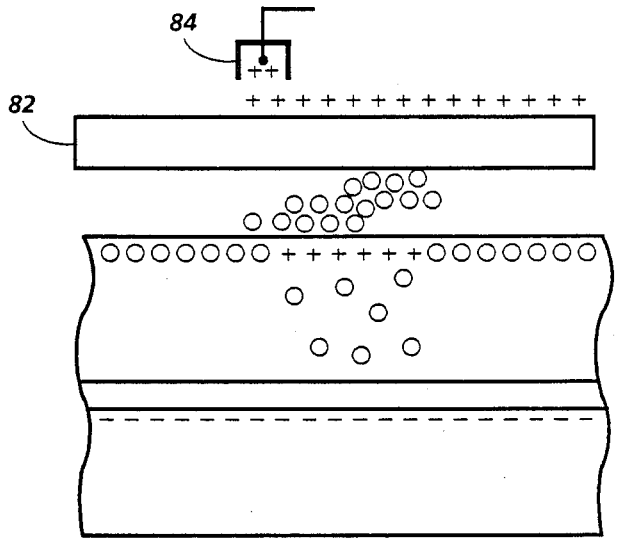
FIG. 15 is a partially schematic, cross-sectional view of a xeroprinting master of this invention from which a deposited toner image is being transferred to a receiving member.
Figure 16:
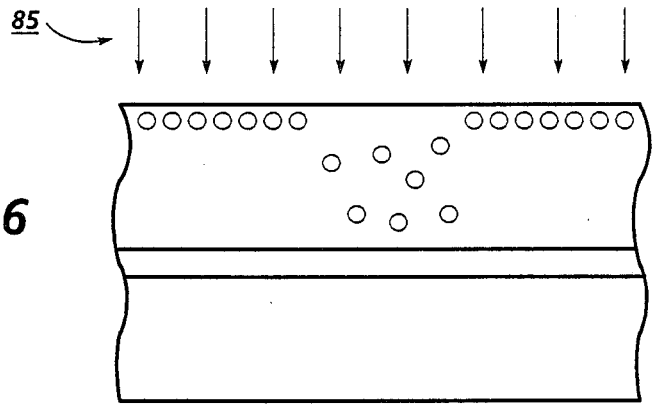
FIG. 16 is a partially schematic, cross-sectional view of a xeroprinting master of this invention being exposed to strong erasing electromagnetic radiation.

The prepared xeroprinting master 72 can thereafter be utilized in a xeroprinting process. The use of xeroprinting master 72 in a xeroprinting process is shown in FIGS. 12 through 16. Referring to FIG. 12, xeroprinting master 72 is uniformly and positively charged by a corona charging device 74. Unlike most earlier approaches illustrated in FIG. 8, however, the xeroprinting master 72 is uniformly insulating in the dark, so there is nothing to cause fringing fields or to defocus the charging ions. The charged xeroprinting master 72 is then uniformly flash exposed to light energy 76 as shown in FIG. 13. As explained above, because of the differences in the relative positions (or particle distribution) of the migration marking material in the $D_{max}$ and $D_{min}$ areas of the softenable layer 56, the $D_{max}$ and $D_{min}$ areas exhibit greatly different photodischarge characteristics and optical absorption characteristics (i.e. $D_{max}$ area being substantially absorbing and $D_{min}$ area being substantially transmitting). Thus, uniform exposure to light energy causes the portions of the imaging surface of softenable layer 56 overlying the $D_{max}$ area (nonmigrated fracturable layer of migration marking material 58) to discharge substantially and the portions overlying the $D_{min}$ area (depthwise dispersed and migrated particles 68) to retain charge substantially, thereby forming an electrostatic latent image on the xeroprinting master as shown in FIG. 13. In other words, the pattern of the depthwise dispersed and migrated electrically photosensitive migration marking particles in the xeroprinting master of the present invention exhibits the characteristics of a relatively poor or "spoiled" photoreceptor and the nonmigrated closely-spaced electrically photosensitive migration marking particles exhibit the characteristics of a good photoreceptor. The words "poor" and "good" are intended here to describe two photoreceptors whose difference in background potential differs by at least 30 percent and preferrably at least 40 percent of the initial applied surface potential, the good photoreceptor being the one exhibiting the higher photodischarge. Thus, the uniform charging and subsequent uniform illumination of the xeroprinting master of this invention causes photodischarge to occur predominately in the $D_{max}$ region of the image. In FIG. 14, the electrostatic latent image is then developed with toner particles 80 to form a toner image corresponding to the electrostatic latent image overlying the $D_{min}$ area. In FIG. 14, the toner particles 80 carry a negative electrostatic charge and are attracted to the oppositely charged portions overlying the $D_{min}$ area (depthwise dispersed and migrated particles). However, if desired, the toner may be deposited in the discharged areas by employing toner particles having the same polarity as the charged areas (positive in the embodiment shown in FIG. 15). The developer will then be repelled by the charges overlying the $D_{min}$ area and deposit in the discharged areas ($D_{max}$ area). Well known electrically biased development electrodes may also be employed, if desired, to direct toner particles to either the charged or discharged areas of the imaging surface. As shown in FIG. 15, the deposited toner image is transferred to a receiving member 82, such as paper, by applying an electrostatic charge to the rear surface of the receiving member by means of a corona device 84. The transferred toner image is thereafter fused by conventional means (not shown) such as an over fuser. After the toned image is transferred, the xeroprinting master can be cleaned, if desired, to remove any residual toner and then erased either by strong electromagnetic radiation 85 as shown in FIG. 16 or by an AC corotron. The developing, transfer, fusing, cleaning and erasure steps may be identical to that conventionally used in xerographic imaging.

The supporting substrate may be either electrically insulating or electrically conductive. The substrate and the entire xeroprinting master precursor member which it supports may be in any suitable form including a web, foil, laminate or the like, strip, sheet, coil, cylinder, drum, endless belt, endless mobius strip, circular disc or other shape. The present invention is particularly suitable for use in any of these configurations. Typical supporting substrates include aluminized polyester, polyester films coated with transparent conductive polymers, metal plates, drums or the like. In some embodiments the electrically conductive substrate may comprise a supporting substrate having a conductive layer or coating coated onto the surface of the supporting substrate. e.g. an aluminized polyester film, upon which the optional charge transport spacing layer or softenable layer is also coated. The substrate may be opaque, translucent, or transparent in various embodiments, including embodiments wherein the electrically conductive layer coated thereon may itself be partially or substantially transparent. The conductive layer may be, for example, a thin vacuum deposited metal or metal oxide coating, a metal foil, electrically conductive particles dispersed in a binder and the like. Typical metals and metal oxides include aluminum, indium, gold, tin oxide, indium tin oxide, silver, nickel, and the like.

Any suitable adhesive material may be employed in the optional adhesive layer of this invention. Typical adhesive materials include copolymers of styrene and an acrylate, polyester resin such as DuPont 49000 (available from E. I. duPont & de Nemours Co.), copolymer of acrylonitrile and vinylidene chloride, polyvinyl acetate, polyvinyl butyral and the like and mixtures thereof. When an adhesive layer is employed, it should form a uniform and continuous layer having a thickness of less than about 0.5 micrometer to ensure satisfactory discharge during the xeroprinting process. It may also optionally include charge transport molecules.

The optional charge transport spacing layer 16 can perform a number of important functions including transport of the injected charge from the imaging softenable layer to the conducting layer; acting as an interfacial adhesive between the imaging softenable layer and the conductive layer or substrate (if the substrate is conductive and no separate conductive layer is employed); and increasing the spacing between the imaging surface and conductive layer to increase the electrostatic contrast potential of the electrostatic image. By separating the film structure into different layers, the present invention allows maximum flexibility in choosing appropriate materials to optimize the mechanical, chemical, electrical, imaging and xeroprinting properties of the imaging member.

The electrostatic contrast potential needed for good quality prints depends on specific kind of developers (for example dry vs. liquid) being used and the development speed required for a particular application. Generally speaking, while a contrast potential in the range of 50–500 volts is adequate for liquid development system, a contrast potential in the range of 200–800 volts is desired for dry toner development system. It should be noted that the electrostatic contrast potential of the electrostatic image of the present invention depends on the combined thickness of the imaging softenable layer and the optional charge transport spacing layer. For dry development system, their combined thickness is generally in the range of from about 4 micrometers to about 30 micrometers, the thickness of the optional charge transport layer being in the range of 2 micrometers to 25 micrometers. Somewhat thinner layers may be utilized, at the expense of decrease in print density and slower development speed. Thicker layers may also be used, but further increase in contrast potential does not result in further improved image quality. Excellent results are achieved with a combined thickness between about 5 micrometers and about 25 micrometers, the thickness of the optional charge transport spacing layer being in the range of 3 micrometers to 20 micrometers. For liquid development system, their combined thickness is generally in the range of from about 3 micrometers to about 25 micrometers, the thickness of the optional charge transport layer being in the range of about 1 micrometer to about 20 micrometers. Excellent results are achieved with a combined thickness between about 4 micrometers and about 20 micrometers, the thickness of the optional charge transport spacing layer being in the range of about 2 micrometers to about 15 micrometers. Assuming, for example, that an electrostatic contrast potential of about 200 volts of the latent image is desired, and that the relative photodischarge in the $D_{max}$ area and in the $D_{min}$ area differs by about 50 percent of the initially applied surface potential, a xeroprinting master then need to be charged to an initial surface potential of about 400 volts. Assuming the xeroprinting master is charged with an applied field of 100 v/$\mu$m, a total thickness of about 4 $\mu$m would satisfy the requirements for both dry and liquid developers.

Although both the softenable layer and the charge transport layer contain charge transport material to enable efficient charge transport, the primary role of the charge transport layer is to transport charge and act as a spacing layer while the role of the softenable layer is to both transport charge and to ensure proper charge injection processes between the migration marking material and the softenable layer in the formation of the visible image. The softenable layer and the charge transport spacing layer may have the same or different charge transport material and/or binder material in order to optimize the mechanical, chemical, electrical, imaging and xeroprinting properties of the imaging member. For example, some materials e.g. a styrene/-hexylmethacrylate copolymer, exhibits excellent migration imaging properties, but insufficient flexibility (especially when its thickness if greatly increased to beyond 10 micrometers) and adhesive properties. On the other hand, other materials, e.g. polycarbonate, exhibits good flexibility and adhesive properties, but relatively poor migration imaging properties. Thus by incorporating a separate charge transport spacing layer between the softenable layer and the substrate, one can choose, for example, a 2 micrometers thick styrene/hexylmethacrylate for the softenable layer and a 10 micrometers thick polycarbonate for the charge transport spacing layer to optimize its imaging, xeroprinting as well as mechanical properties.

The optional charge transport spacing layer 16 comprises any suitable film forming binder material. Typical film forming binder materials include styrene acrylate copolymers, polycarbonates, co-polycarbonates, polyesters, co-polyesters, polyurethanes, polyvinyl acetate, polyvinyl butyral, polystyrenes, alkyd substituted polystyrenes, styrene-olefin copolymers, styrene-co-n-hexylmethacrylate, a custom synthesized 80/20 mole percent copolymer of styrene and hexylmethacrylate having an intrinsic viscosity of 0.179 dl/gm; other copolymers of styrene and hexylmethacrylate, styrene-vinyltoluene copolymer, polyalpha-methylstyrene, mixtures and copolymers thereof. The above group of materials is not intended to be limiting, but merely illustrative of materials suitable for film forming binder material in the optional charge transport spacing layer. The film forming binder material is typically substantially electrically insulating and does not adversely chemically react during the xeroprinting master making and xeroprinting steps of the present invention. Although the optional charge transport spacing layer has been described as coated on a substrate, in some embodiments, the charge transport spacing layer itself may have sufficient strength and integrity to be substantially self supporting and may, if desired, be brought into contact with a suitable conductive substrate during the imaging process. As is well known in the art, a uniform deposit of electrostatic charge of suitable polarity may be substituted for a conductive layer. Alternatively, a uniform deposit of electrostatic charge of suitable polarity on the exposed surface of the charge transport spacing layer may be substituted for a conductive layer to facilitate the application of electrical migration forces to the migration layer. This technique of "double charging" is well known in the art.

Charge transport molecules for the charge transport spacing layer are described in greater detail below in the description of the softenable layer. The specific charge transport molecule utilized in the charge transport spacing layer of any given master may be identical to or different from the charge transport molecule employed in the adjacent softenable layer. Similarly, the concentration of the charge transport molecule utilized in the charge transport spacing layer of any given master may be identical to or different from the concentration of charge transport molesucle employed in the adjacent softenable layer. When the charge transport material and film forming binder are combined to form the charge transport spacing layer, the amount of charge transport material used may vary depending upon the particular charge transport material and it compatibility (e.g. solubility) in the continuous insulating film forming binder. Satisfactory results have been obtained using between about 10 percent and about 50 percent based on the total weight of the optional charge transport spacing layer. A somewhat lower concentration of the charge transport molecule may be used, but may cause increased background potential, because of inefficient charge transport. When the concentration of the charge transport molecule exceeds about 50 percent, crystallization of the charge transport molecules in the charge transport layer may occur and charge dark decay may also be higher. Moreover, very large concentration of the charge transport molecules may also cause the layer to lose its mechanical strength, flexiblity and integrity.

The image forming softenable layer is a layer in which images of migration marking material are formed. The image forming softenable layer comprises closely spaced, submicron sized migration marking material embedded just below the surface of an electrically insulating softenable material such as a matrix polymer. The softenable material is also doped with charge transport materials which may be the same or different from those used in the charge transport spacing layer.

In various modifications of the xeroprinting masters utilized in the present invention, the migration marking material is preferably electrically photosensitive, photoconductive, or of any other suitable combination of materials. Typical migration marking materials are disclosed, for example, in U.S. Pat. No. 4,536,457, U.S. Pat. No. 4,536,458, U.S. Pat. No. 3,909,262, and U.S. Pat. No. 3,975,195, the disclosures of these patents being incorporated herein in their entirety. Specific examples of migration marking materials include selenium and selenium-tellurium alloys. The migration marking materials should be particulate and closely spaced from each other. The preferred migration marking materials are generally spherical in shape and submicron in size. These spherical migration marking materials are well known in the migration imaging art. Excellent results are achieved with spherical migration marking materials ranging in size from about 0.2 micrometer to about 0.4 micrometer and more preferably from about 0.3 micrometer to about 0.4 micrometer embedded as a subsurface monolayer in the external surface (surface spaced from the substrate if an overcoating is employed) of the softenable layer. The spheres of the migration marking material are preferably spaced from each other by a distance of less than about one-half the diameter of the spheres for maximum optical density. The spheres are also preferably from about 0.01 micrometer to about 0.1 micrometer below the outer surface (surface spaced from the substrate if an overcoating is employed) of the softenable layer. An especially suitable process for depositing the migration marking material in the softenable layer is described in U.S. Pat. No. 4,482,622 issued to P. Soden and P. Vincett, the disclosure of which is incorporated herein in its entirety. For the purposes of the present invention, it is highly preferred that the migration marking material have a sufficiently low melting point that its self-diffusion is rapid at the temperatures used for deposition. The deposition temperatures must not exceed the degradation point of the softenable material, the substrate or any other component of the migration imaging member. The word "rapid" is intended to mean that particles of migration marking material which are in contact should coalesce preferably within a fraction of a second or at most within about two minute.

The softenable material may be any suitable material which may be softened either by heat or by solvent vapors. In addition, in the xeroprinting master embodiments, the softenable material is typically substantially electrically insulating and does not chemically react during the master preparative steps and xeroprinting steps of the present invention. Although the softenable layer has been described as coated on a substrate, in some embodiments, the softenable layer may itself have sufficient strength and integrity to be substantially self supporting. Should an attached conductive layer not be utilized, uniform deposit of electrostatic charges of suitable polarities on the exposed surface of the softenable layer or the optional overcoating layer may be used to facilitate the application of electrical migration forces to the imaging member. This technique of "double charging" is well known in the art. Alternatively, the softenable layer may itself be brought into contact with a suitable conductive surface during the master making and xeroprinting processes.

Any suitable solvent swellable, softenable material may be utilized in the softenable layer. Typical swellable, softenable materials include styrene acrylate copolymers, polystyrenes, alkyd substituted polystyrenes, styrene-olefin copolymers, styrene-co-n-hexylmethacrylate, a custom synthesized 80/20 mole percent copolymer of styrene and hexylmethacrylate having an intrinsic viscosity of 0.179 dl/gm, other copolymers of styrene and hexylmethacrylate, styrene-vinyltoluene copolymer, polyalpha-methylstyrene, co-polyesters, polyesters, polyurethane, polycarbonate, co-polycarbonates, mixtures and copolymers thereof. The above group of materials is not intended to be limiting, but merely illustrative of materials suitable for such softenable layers.

Any suitable charge transport material capable of acting as a softenable layer material or which is soluble or dispersible on a molecular scale in the softenable layer material may be utilized in the softenable layer of this invention. The charge transport material is defined as an electrically insulating film-forming binder or a soluble or molecularly dispersable material dissolved or molecularly dispersed in an electrically insulating film-forming binder which is capable of improving the charge injection process (for at least one sign of charge) from the marking material into the softenable layer (preferably prior to, or at least in the early stages of, development by softening of the softenable layer), the improvement being by reference to an electrically inert insulating softenable layer. The charge transport materials may be hole transport materials and/or electron transport materials, that is, they may improve the injection of holes and/or electrons from the marking material into the softenable layer. Where only one polarity of injection is improved, the sign of ionic charge used to uniformly charge the xeroprinting master in the xeroprinting process for the purposes of this invention is most commonly the same as the sign of charge whose injection is improved. The selection of a combination of a specific transport material with a specific marking material should therefore be such that the injection of holes and/or electrons from the marking material into the softenable layer is improved compared to a softenable layer which is free of any transport material. Where the charge transport material is to be dissolved or molecularly dispersed in an insulating film-forming binder, the combination of the charge transport material and the insulating film-forming binder should be such that the charge transport material may be incorporated into the film-forming binder in sufficient concentration levels while still remaining in solution or molecularly dispersed. If desired, the insulating film-forming binder need not be utilized where the charge transport material is a polymeric film-forming material.

Any suitable charge transporting material may be used. Charge transporting materials are well known in the art. Typical charge transporting materials include the following:

Diamine transport molecules of the types described in U.S. Pat. No. 4,306,008, U.S. Pat. No. 4,304,829, U.S. Pat. No. 4,233,384, U.S. Pat. No. 4,115,116, U.S. Pat. No. 4,299,897 and U.S. Pat. No. 4,081,274. Typical diamine transport molecules include N,N'-diphenyl-N,N'-bis(3''-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'-biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

Pyrazoline transport molecules as disclosed in U.S. Pat. No. 4,315,982, U.S. Pat. No. 4,278,746, and U.S. Pat. No. 3,837,851. Typical pyrazoline transport molecules include 1-[lepidyl-(2)[-3-(p-diethylaminophenyl)-5-(p-diethylaminophenyl)pyrazoline, 1-[quinolyl-(2)]-3-(p-diethylaminophenyl)-5-(p-diethylaminophenyl)-pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)-pyrazoline, and the like.

Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorene, 2-nitro-9-benzylidene-fluorene, 2-nitro-9-(4'-diethylaminobenzylidene)fluorene and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Pat. Nos. 1,058,836, 1,060,260 and 1,120,875.

Hydrazone transport molecules such as p-diethylamino benzaldehyde-(diphenyl hadrazone)), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde-(diphenylhydrazone), 1-naphthalenecarbaldehyde 1-methyl-1-phenylhydrazone, 1-naphthalenecarbaldehyde 1,1-phenylhydrazone, 4-methoxynaphthlene1-carbaldehyde 1-methyl-1-phenylhydrazone and the like. Other typical hydrazne transport molecules described, for example, in U.S. Pat. No. 4,150,987, U.S. Pat. No. 4,385,106, U.S. Pat.No. 4,338,388 and U.S. Pat. No. 4,387,147.

Carbazole phenylhydrazone transport molecules such as 9-ethylcarbazole-3-carboaldehyde-1-methyl-1-phenyl hydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and the like. Other typical carbazole phenyl hydrazone transport molecules are described in U.S. Pat. No. 4,256,821 and U.S. Pat. No. 4,297,426.

Vinyl-aromatic polymers such as polyvinyl anthracene, polyacenaphthylene; formaldehyde condensation products with various aromatics such as condensates of formaldehyde and 3-bromopyrene; 2,4,7-trinitrofluorenone, and 3,6-dinitro-N-t-butyl-naphthalimide as described in U.S. Pat. No. 3,972,717.

Oxadiazole derivatives such as 2,5-bis-(p-diethylaminophenyl)oxadiazole-1,3,4 described in U.S. Pat. No. 3,895,844.

Tri-substituted methanes such as alkyl-bis(N,N-dialkylaminoaryl)methane, cycloalkyl-bis(N,N-dialkylaminoaryl)methane, and cycloalkenyl-bis-(N,N-dialkylaminoaryl)methane as described in U.S. Pat. No. 3,820,989.

9-fluorenylidene methane derivatives having the formula:

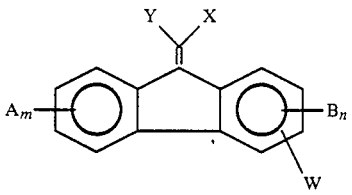

wherein X and Y are cyano groups or alkoxycarbonyl groups, A, B, and W are electron withdrawing groups independently selected from the group consisting of acyl, alkoxycarbonyl, nitro, alkylaminocarbonyl and derivatives thereof, m is a number of from 0 to 2, and n is the number 0 or 1 as described in copending in U.S. Pat. No. 4,474,865. Typical 9-fluorenylidene methane derivatives encompassed by the above formula include (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like.

Other charge transport materials include as poly-1-vinylpyrene, poly9-vinylanthracene, poly-9-(4-pentenyl)-carbazole, poly-9-(5-hexyl)-carbazole, polymethylene pyrene, poly-1-(pyrenyl)butadiene, polymers such as alkyl, nitro, amino, halogen, and hydroxy substitute polymers such as poly-3-amino carbazole, 1,3-dibromo-poly-N-vinyl carbazole and 3,6-dibromo-poly-N-vinyl carbazole and numerous other transparent organic polymeric or non-polymeric transport materials as described in U.S. Pat. No. 3,870,516.

The disclosures of each of the patterns identified above pertaining to charge transport molecules which are soluble or dispersible on a molecular scale in a film forming binder are incorporated herein in their entirety.

When the charge transport materials are combined with an insulating binder to form the softenable layer, the amount of charge transport material which is used may vary depending upon the particular charge transport material and its compatibility (e.g. solubility) in the continuous insulating film forming binder phase of the softenable layer and the like. Satisfactory results are obtained using between about 8 percent to about 50 percent by weight charge transport material based on the total weight of the softenable layer. A particularly preferred charge transport molecule is one having the general formula:

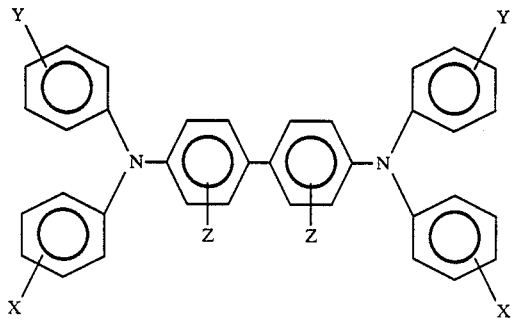

wherein X, Y and Z are selected from the group consisting of hydrogen, an alkyl group having from 1 to about 200 carbon atoms and chlorine and at least one of X, Y and Z is independently selected to be an alkyl group having from 1 to about 20 carbon atoms or chlorine. If Y and Z are hydrogen, the compound may be named N,N'-bis(alkylphenyl)-[1,1'-biphenyl]-4,4'-diamine wherein the alkyl is, for example, methyl, ethyl, propyl, n-butyl, etc. or the compound may be N,N'-diphenyl-N,N'-bis(chlorophenyl)-4,4'-biphenyl]-4,4'-diamine. Excellent results including exceptional storage stability may be achieved when the softenable layer contains between about 10 percent to about 40 percent by weight of these diamine compounds based on the total weight of the softenable layer. Optimum results are achieved when the softenable layer contains between about 16 percent to about 40 percent by weight of N,N'-diphenyl-N,N'-bis(3''-methylphenyl)-(1,1'-biphenyl)-4,4'-diamine based on the total weight of the softenable layer. Although charge transport material in the softenable layer is not required for the formation of the migration image in the xeroprinting master, charge transport capability is essential for the xeroprinting process. When the softenable layer contains less than about 8 percent by weight of these diamine compounds based on the total weight of the softenable layer, the extent of photodischarge in the $D_{max}$ area may become less because of inefficient charge transport and charge trapping in the softenable layer may cause cycle-up during xeroprinting imaging cycles. When the concentration of the charge transport molecule is more than about 50 percent by weight of these diamine compounds based on the total weight of the softenable layer, the mechanical strength, flexibility and integrity of the softenable layer are somewhat degraded and charge dark decay may become higher. Moreover, very large concentrations of these diamine compounds may cause crystallization of the compounds in the softenable layer.

The charge transport material may be incorporated into the softenable layer and optional charge transport spacing layer by any suitable technique. For example, it may be mixed with the softenable layer or spacing layer components by dissolution in a common solvent. If desired, a mixture of solvents for the softenable or spacing layer may be used to facilitate mixing and coating.

The optional adhesive layer, optional charge transport spacing layer and softenable layer may be applied to the substrate by any conventional coating process. In the coating of these multi-layers, appropriate measures should be taken to ensure that coating of one layer does not result in dissolution of the underlying layer. This can be accomplished by appropriate choice of the film-forming binder materials and their solvent or mixture of solvents. Typical coating processes include draw bar, spraying, extrusion, dip, gravure roll, wire wound rod, air knife coating and the like. The thicknesses of the adhesive and charge transport spacing layers have been discussed above. The thickness of the deposited softenable layer depends on whether a charge transport spacing layer is used or not. If a charge transport spacing layer having a thickness in the range of about 1–25 micrometers is used, the thickness of the deposited softenable layer after any drying or curing step is preferably in the range of about 2–5 micrometers. Thickness less than 2 micrometer may be utilized for the softenable layer, at the expense of slight increase in $D_{min}$, because sufficient room is required to provide maximum dispersion of the migrated particles in the $D_{min}$ area. Additionally, increased $D_{min}$ (i.e. insufficient dispersion of the migrated particles) may cause the photodischarge in the $D_{min}$ area to increase, resulting in decreased electrostatic contrast potential during xeroprinting. The use of a charge transport layer renders the use of a softenable layer thicker than about 5 micrometers unnecessary. However if a charge transport layer is not used, the thickness of the softenable layer is preferably in the range of about 3–30 micrometers to give sufficiently high electrostatic contrast potential to suit a particular application. Layers thicker than about 25 micrometers may also be utilized, but do not give further improvement in print quality.

Incorporation of the charge transport material into the softenable layer and the charge transport layer imparts to the imaging member of the present invention the usefulness as a xeroprinting master.

If desired, solvent vapor may be used, instead of heat, to soften the softenable layer to allow depthwise migration and dispersion of the light-exposed migration marking particles in the preparation of the xeroprinting master for xeroprinting. Any suitable solvent for the softenable material in the softenable layer may be employed. Upon contact, the solvent vapor should soften the softenable layer sufficiently to allow the light-exposed migration marking material to migrate in depth in the softenable layer towards the substrate in image configuration. Typical commonly used solvents includes toluene, ethyl acetate, ketones, 1,1,1 trichlorethane, methylene chloride etc and/or their mixtures. Softening of the softenable layer sufficiently to allow migration in depth of migration marking material towards the substrate in image configuration may be effected by contact with vapors of solvents or mixtures of solvents. If desired, the mixtures of solvents may comprise a mixture of poor solvents and good solvents for the softenable material to control the degree of softening of the softenable material within a given period of time. Typical combinations of softenable materials and solvents or combinations of solvents include styrene ethylacrylate copolymer and toluene solvent, styrene hexylmethacrylate copolymer and toluene, styrene, hexylmethacrylate copolymer and ethyl acetate solvent, styrene hexylmethacrylate copolymer and 1,1,1 trichlorethane, styrene hexylmethacrylate copolymer and mixture of toluene and isopropanol solvents, styrene butadiene copolymer and mixture of ethyl acetate and butyl acetate solvents. If an optional overcoating layer is used on top of the softenable layer to improve abrasion resistance and if solvent softening is employed, the overcoating layer should be permeable to the vapor of the solvent used and additional vapor treatment time should be allowed so that the solvent vapour can soften the softenable layer sufficiently to allow the light-exposed migration marking material to migrate in depth of migration marking material towards the substrate in image configuration. Solvent permeability is unnecessary for an overcoating layer if heat is employed to soften the softenable layer sufficiently to allow the exposed migration marking material to migrate in depth towards the substrate in image configuration.

The optional overcoating layer may be substantially electrically insulating, or have any other suitable properties. The overcoating should be substantially transparent, at least in the spectral region where electromagnetic radiation is used for imagewise exposure step in the master making process and for the uniform exposure step in the xeroprinting process. The overcoating layer is continuous and preferably of a thickness up to about 1–2 micrometers. Preferably, the overcoating should have a thickness of between about about 0.1 micrometer and about 0.5 micrometer to minimize residual charge buildup. Overcoating layers greater than about 1 to 2 micrometers thick may also be used, but may cause slight cycle-up when multiple prints are made during xeroprinting because of the tendency of charge trapping to occur in the bulk of the overcoating layer. Typical overcoating materials include acrylic-styrene copolymers, methacrylate polymers, methacrylate copolymers, styrene-butylmethacrylate copolymers, butylmethacrylate resins, vinylchloride copolymers, fluorinated homo or copolymers, high molecular weight polyvinyl acetate, organosilicon polymers and copolymers, polyesters, polycarbonates, polyamides, polyvinyl toluene and the like. The overcoating layer should protect the softenable layer 18 in order to provide greater resistance to the adverse effects of abrasion during handling, master making and xeroprinting. The overcoating layer preferably adheres strongly to the softenable layer to minimize damage. The overcoating layer may also have abhesive properties at its outer surface which provide improved resistance to toner filming during toning, transfer and/or cleaning. The abhesive properties may be inherent in the overcoating layer or may be imparted to the overcoating layer by incorporation of another layer or componenet of abhesive material. These abhesive materials should not degrade the film forming components of the overcoating and should preferably have a surface energy of less than about 20 ergs/cm$^2$. Typical abhesive materials include fatty acids, salts and esters, fluorocarbons, silicones and the like. The coatings may be applied by any suitable technique such as draw bar, spray, dip, melt extrusion or gravure coating. It will be appreciated that these overcoating layers protect the xeroprinting master before imaging, during imaging, after the members have been imaged, and during xeroprinting.

Referring again to the xeroprinting master precursor members illustrated in FIGS. 1, 2 and 3, the master precursor members are developed after charging and imagewise exposure by the application of either heat or solvent vapor. If the substrate 12, conductive layer 14 and adhesive layer 22 are light transmitting, these members, when imaged, may be visible light transmitting because of the migration in depth of the migration marking material in the exposed region.

In FIG. 9, a xeroprinting master precursor member is shown comprising substrate 52 having conductive coating 54 thereon, softenable layer 56, a layer of migration marking material 58 contiguous the surface of the softenable layer 56. An electrical latent image may be formed on the imaging member by uniformly electrostatically charging the member and exposing the charged member to imagewise activating electromagnetic radiation prior to substantial dark decay of the uniform charge as shown in FIGS. 9 and 10. The imaging member is shown in FIG. 9 as being electrostatically charged negatively with corona charging device 60. Where substrate 52 is conductive or has a conductive coating 54, the conductive layer is grounded or maintained at a predetermined potential during electrostatic charging. Another method of electrically charging a member having an insulating rather than a conductive substrate is to electrostatically charge both sides of the member to surface potentials of opposite polarities.

In FIG. 10, the charged unimaged member is shown being exposed to activating electromagnetic radiation 62 thereby forming an electrostatic latent image upon the master. Exposure in an imagewise pattern to form an electrical latent image upon the xeroprinting master precursor member should be effected prior to substantial dark decay of the deposited surface charge. Satisfactory results may be obtained if the dark decay is less than about 50 percent of the initial charge. Thus the expression "prior to substantial decay" is intended to mean the dark decay is less than about 50 percent of the initial charge. A dark decay of less than about 25 percent of the initial charge is prefered for optimum imaging of the xeroprinting master precursor member.

The xeroprinting master precursor member having the electrical latent image thereon is then developed by uniformly applying heat energy to the member as shown in FIG. 11. The heat development temperature and time depend upon factors such as the how the heat energy is applied (e.g. conduction, radiation, convection and the like), the melt viscocity of the softenable layer, thickness of the softenable layer, the amount of heat energy and the like. For example, at a temperature of 110° C. to about 130° C., heat need only be applied for a few seconds. For lower temperatures, more heating time may be required. When the heat is applied, the softenable layer 56 decreases in viscosity thereby decreasing its resistance to migration of the marking material in depth through the softenable layer 56. In the exposed region, the migration making particles gain a substantial net charge which upon softening of the softenable layer causes these exposed particles to migrate in image configuration towards the substrate and disperse in depth of the softenable layer, resulting in a $D_{min}$ area. The unexposed migration marking particles in the unexposed region remain essentially neutral and uncharged. Thus in the absence of migration force, the unexposed migration making particles remain substantially in their original position, resulting in a $D_{max}$ area. Thus, in FIG. 11, the migration marking material is shown substantially migrated and dispersed in depth in the exposed region and remaining substantially in their original position in the unexposed region. The exposed and unexposed regions correspond to the formation of the electrical latent image described in conjunction with FIGS. 10 and 11. Thus, the process of preparing the xeroprinting master produces optically sign-retaining images from positive originals (if conventional light-lens systems are used to exposed the imaging member). Obviously, exposure may be effected by means other than light-lens systems, e.g. Raster Output Scanning devices such as laser writers.

If desired, solvent vapor development may be substituted for heat development. Vapor development of migration imaging members is well known in the art. Generally, if solvent vapor softening is utilized, the solvent vapor exposure time depends upon factors such as the solubility of softenable layer in the solvent, the type of solvent vapor, the ambient temperature and the concentration of the solvent vapors and the like.

The application of either heat, or solvent vapors, or combinations thereof, or any other suitable means should be sufficient to decrease the resistance of the softenable material of softenable layer 56 to allow migration of the migration marking material in depth in softenable layer 56 in imagewise configuration. With heat development, satisfactory results may be achieved by heating the imaging member to a temperature of about 100° C. to about 130° C. for only a few seconds when the unovercoated softenable layer contains a custom synthesized 80/20 mole percent copolymer of styrene and hexylmethacrylate having an intrinsic viscosity of 0.179 dl/gm and N,N'-diphenyl-N,N'-bis(3''-methylphenyl)-(1,1'-biphenyl)-4,4'-diamine. The test for a satisfactory combination of time and temperature is to maximize optical contrast density and electrostatic contrast potential for xeroprinting. With vapor development, satisfactory results may be achieved by exposing the imaging member to the vapor of toluene for between about 4 seconds and about 60 seconds at a solvent vapor partial pressure of between about 5 millimeters and 30 millimeters of mercury when the unovercoated softenable layer contains a custom synthesized 80/20 mole percent copolymer of styrene and hexylmethacrylate having an intrinsic viscosity of 0.179 dl/gm and N,N'-diphenyl-N,N'-bis(3''-methylphenyl)-1,1'-biphenyl)-4,4'-diamine.

The imaged xeroprinting master illustrated in FIG. 12 is shown without any optional layers like that illustrated in FIG. 3. If desired, alternative master embodiments like that illstrated in FIG. 1 or FIG. 2 may be substituted for the coated member illustrated in FIGS. 3 and 12.

The imaged xeroprinting master shown in FIG. 12 is transmitting to visible light in the exposed region because of the depthwise migration and dispersion of the migration marking material in the exposed region. The $D_{min}$ obtained in the exposed region is slightly higher than the optical density of transparent substrates underlying the softenable layer. The $D_{max}$ in the unexposed region is essentially the same as the original unprocessed imaging member because the positions of migration marking particles in the unexposed regions remain essentially unchanged. Thus, sign-retaining visible images with high contrast density in the region of 0.9 to 1.3 may be achieved for xeroprinting masters. In addition, exceptional resolution such as 228 line pairs per millimeter may be achieved on the xeroprinting masters.

In the imaging process for preparing the masters used in the xeroprinting process of this invention, in order to achieve the excellent results of this invention, the exposed migration imaging particles gain an appreciable net charge and migrate considerably toward the substrate to produce a relatively low optical density region when processed with either heat or solvent vapor to soften the softenable layer during the development step. Furthermore, the unexposed particles remain substantially uncharged and do not migrate during the softening step; thus the exposed particles remain substantially uncharged in the oringinal monolayer configuration.

Although charge transport material in the softenable layer is not required for sole purpose of forming the migration image in the xeroprinting master, charge transport capability is essential if the imaged member is to be used in the xeroprinting process. Incorporation of charge transport material into the softenable layer and the charge transport spacing layer imparts to the imaging member of the present invention the ability to function as a xeroprinting master. Suitable concentration of charge transport materials can be experimentally determined by maximizing the optical contrast density of the obtained optically sign-retaining images as well as the electrostatic contrast potential needed for xeroprinting as a function of the concentration. Charge transport must also extend through the matrix of the softenable layer on exposure both to produce the required latent image contrast and to ensure freedom from residual charge buildup on rapid cycling.

The prepared xeroprinting master can thereafter be utilized in a xeroprinting process where the xeroprinting master is uniformly charged by corona charging.

The polarity of corona charging to be used in the xeroprinting process is determined by whether hole transport materials or electron transport materials are incorporated into the softenable layer and the charge transport layer. Positive corona charging is used with hole transport material in the softenable layer and the charge transport layer. When electron transport material is used in the softenable layer and the charge transport layer, the xeroprinting master is uniformly charged negatively. The prepared xeroprinting master is uniformly charged positively with a corona charging device as shown in FIG. 12 for illustrative purposes.

The charged imaging member is then uniformly flash exposed as shown in FIG. 13 to form an electrostatic latent image. As discussed above, because of the difference in relative location and distribution of migration marking particles, the $D_{max}$ area and the $D_{min}$ area of the xeroprinting master exhibit not only greatly different optical densities (the $D_{max}$ are being highly absorbing and $D_{min}$ area being transmitting), but also greatly different photodischarge when the xeroprinting master of this invention is uniformly charged and then uniformly exposed to light, i.e. activating electromagnetic radiation or illumination. Thus, upon uniform charging and uniform exposure to activating illumination of the xeroprinting master, photodischarge occurs predominantly in the $D_{max}$ area and substantially less occurs in the $D_{min}$ area of the xeroprinting master, resulting in an electrostatic latent image. Charge is substantially retained in the regions containing the migrated marking particles and is substantially dissipated in the regions containing the unmigrated particles. The activating illumination for the uniform exposure step should be substantially absorbed by the migration marking particles to cause substantial photodischarge in the $D_{max}$ area. The activating electromagnetic radiation used for the uniform exposure step should be in the spectral region where the migration marking particles photogenerate charge carriers. Monochromatic light in the region of 300–500 nanometers is preferred for selenium particles to maximize the electrostatic contrast potential of the electrostatic latent image. The exposure energy should be such that the desired and/or optimal electrostatic contrast potential is obtained. Thus, the xeroprinting master in accordance with our invention can be considered as an imagewise "spoiled" photoreceptor, the $D_{max}$ area (unmigrated marking particles) being a good photoreceptor and the $D_{min}$ area (migrated) being a relatively poor photoreceptor. The words "poor" and "good" are intended to describe two photoreceptors whose difference in background potential differs by at least 30 percent and preferrably at least 40 percent of the initial applied surface potential, the good photoreceptor being the one exhibiting the higher photodischarge. This imagewise "spoiled" photoreceptor possesses different photodischarge characteristics (and photosensitivity) caused by permanent structural changes of the migration marking material in the softenable layer. Generally, the $D_{max}$ areas (unmigrated region) exhibit substantial photodischarge when electrostatically charged and exposed to light and are substantially absorbing and opaque to activating electromagnetic radiation in the spectral region in which the migration marking particles photogenerate charge carriers. The $D_{min}$ areas (migrated region) exhibit substantially less photodischarge so that the background potential differs by at least about 30 percent, and more preferably at least about 40 percent of the initial applied surface potential compared with the $D_{max}$ areas, and are substantially less absorbing to activating electromagnetic radiation in the spectral region in which the migration marking particles photogenerate charge carriers. Since the electrostatic latent image is regenerated for each printing cycle as in a conventional photoreceptor, this greatly improved structure of xeroprinting master of the present invention ensures consistently excellent copy quality without the problem of degradation of the electrostatic latent image, as in some prior art masters, for example, as discussed above and described in U.S. Pat. No. 4,407,918, in which the lifetime of the electrostatic latent image depends on the insulating ability of a charge retentive layer. It should be noted that while the visible image on the xeroprinting master is an optically sign-retaining image of a positive original (if the master is created by lens coupled exposure instead of laser scanning), the electrostatic charge pattern is a negative (sign-reversed) of the original image.

The electrostatic latent image is then developed with toner particles to form a toner image corresponding to the electrostatic latent image. The developing (toning) step is identical to that conventionally used in xerographic imaging. Any suitable conventional xerographic dry or liquid developer containing electrostatically attractable marking particles may be employed to develop the electrostatic latent image on the xeroprinting masters of this invention. Typical dry toners have a particle size of between about 6 micrometers and about 20 micrometers. Typical liquid toners have a particle size of between about 0.1 micrometers and about 3 micrometers. The size of toner particles affect the resolution of prints. For applications demanding very high resolution such as in color proofing and printing, liquid toners are generally preferred because their much smaller toner particle size gives better resolution of fine half-tone dots and produce four color images without undue thickness in dense black areas. Transferrable liquid developed toners are typically about 2 micrometers in diameter. Conventional xerographic development techniques may be utilized to deposit the toner particles on the imaging surface of the xeroprinting masters of this invention.

This invention is suitable for development with dry two-component developers. Two-component developers comprise toner particles and carrier particles. Typical toner particles may be of any composition suitable for development of electrostatic latent images, such as those comprising a resin and a colorant. Typical toner resins include polyesters, polyamides, epoxies, polyurethanes, diolefins, vinyl resins and polymeric esterification products of a dicarboxylic acid and a diol comprising a diphenol. Examples of vinyl monomers include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids, including methyl acrylate, ethyl acrylate, n-butylacrylate, isobutyl acrylate, dodecyl acrylate, n-octyl acrylate,2-chloroethyl acrylate, phenyl acrylate, methylalpha-chloroacrylate, methyl methacrylate, ethyl methacrylate, butyl methacrylate, and the like; acrylonitrile, methacrylonitrile, acrylamide, vinyl esthers, including vinyl methyl ether, vinyl isobutyl ether, and vinyl ethyl ether; vinyl ketones such as vinyl methyl ketone, vinyl hexyl ketone, and methyl isopropenyl ketone; N-vinyl indole and N-vinyl pyrrolidene; styrene butadienes; mixtures of these monomers; and the like. The resins are generally present in an amount of from about 30 to about 99 percent by weight of the toner composition, although they may be present in greater or lesser amounts, provided that the objectives of the invention are achieved.

Any suitable pigment or dyes may be employed in the toner particles. Typical pigments or dyes include carbon black, nigrosine dye, aniline blue, magnetites, and mixtures thereof, with carbon black being the preferred colorant. The pigment is preferably present in an amount sufficient to render the toner composition highly colored to permit the formation of a clearly visible image on a recording member. Generally, the pigment particles are present in amounts of from about 1 percent by weight to about 20 percent by weight based on the total weight of the toner composition; however, lesser or greater amounts of pigment particles may be present provided that the objectives of the present invention are achieved.

Other colored toner pigments include red, green, blue, brown, magenta, cyan, and yellow particles, as well as mixtures thereof. Illustrative examples of suitable magenta pigments include 2,9-dimethyl-substituted quinacridone and anthraquinone dye, identified in the color index as Cl 60710, Cl Dispersed Red 15, a diazo dye identified in the color index as Cl 26050, Cl Solvent Red 19, and the like. Illustrative examples of suitable cyan pigments include copper tetra-4-(octadecyl sulfonamido) phthalocyanine, X-copper phthalocyanine pigment, listed in the color index as Cl 74160, Cl Pigment Blue, and Anthradanthrene Blue, identified in the color index as Cl 69810, Special Blue X-2137, and the like. Illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonamide identified in the color index as Foron Yellow SE/GLN, Cl Dispersed Yellow 33, 2,5-dimethoxy-4-sulfonanilide phenylazo-4'-chloro-2,5-dimethoxy aceto-acetanilide, Permanent Yellow FGL, and the like. These color pigments are generally present in an amount of from about 15 weight percent to about 20.5 weight percent based on the weight of the toner resin particles, although lesser or greater amounts may be present provided that the objectives of the present invention are met.

When the pigment particles are magnetites, which comprise a mixture of iron oxides ($Fe_3O_4$) such as those commercially available as Mapico Black. These pigments are present in the toner composition in an amount of from about 10 percent by weight to about 70 percent by weight, and preferably in an amount of from about 20 percent by weight to about 50 percent by weight, although they may be present in greater or lesser amounts, provided that the objectives of the invention are achieved.

The toner compositions may be prepared by any suitable method. For example, the components of the dry toner particles may be mixed in a ball mill, to which steel beads for agitation are added in an amount of approximately five times the weight of the toner. The ball mill may be operated at about 120 feet per minute for about 30 minutes, after which time the steel beads are removed. Dry toner particles for two-component developers generally have an average particle size between about 6 micrometers and about 20 micrometers.

Any suitable external additives may also be utilized with the dry toner particles. The amounts of external additives are measured in terms of percentage by weight of the toner composition, but are not themselves included when calculating the percentage composition of the toner. For example, a toner composition containing a resin, a pigment, and an external additive may comprise 80 percent by weight resin and 20 percent by weight pigment; the amount of external additive present is reported in terms of its percent by weight of the combined resin and pigment. External additives may include any additives suitable for use in electrostatographic toners, including straight silica, colloidal silica (e.g. Aerosil R972®, available from Degussa, Inc.), ferric oxide, unilin, polypropylene waxes, polymethylmethacrylate, zinc stearate, chromium oxide, aluminum oxide, stearic acid, polyvinylidene flouride (e.g. Kynar®, available from Pennsalt Chemicals Corporation), and the like. External additives may be present in any suitable amount, provided that the objectives of the present invention are achieved.

Any suitable carrier particles may be employed with the toner particles. Typical carrier particles include granular zircon, steel, nickel, iron ferrites, and the like. Other typical carrier particles include nickel berry carriers as disclosed in U.S. Pat. No. 3,847,604, the entire disclosure of which is incorporated herein by reference. These carriers comprise nodular carrier beads of nickel characterized by surfaces of reoccurring recesses and protrusions that provide the particles with a relatively large external area. The diameters of the carrier particles may vary, but are generally from about 50 microns to about 1,000 microns, thus allowing the particles to possess sufficient density and inertia to avoid adherence to the electrostatic images during the development process. Carrier particles may possess coated surfaces. Typical coating materials include polymers and terpolymers, including, for example, fluoropolymers such as polyvinylidene fluorides as disclosed in U.S. Pat. Nos. 3,526,533; 3,849,186; and 3,942,979, the entire disclosures of which are incorporated herein by reference. The toner may be present, for example, in the two-component developer in an amount equal to about 1 to about 3 percent by weight of the carrier, and preferably is equal to about 3 percent by weight of the carrier.

Typical dry toners are disclosed, for example, in U.S. Pat. Nos. 2,788,288, U.S. Pat. No. 3,079,342 and U.S. Reissue No. 25,136, the disclosures of which are incorporated herein in their entirely. If desired development may be effected with liquid developers. Liquid developers are disclosed, for example, in U.S. Pat. No. 2,890,174 and U.S. Pat. No. 2,899,335. Liquid developers may comprise aqueous base or oil based inks. This includes both inks containing a water or oil soluble dye substance and the pigmented inks. Typical dye substances are Methylene Blue, commercially available from Eastman Kodak Company, Brilliant Yellow, commercially available from the Harlaco Chemical Co., potassium permanganate, ferric chloride and Methylene Violet, Rose Bengal and Quinoline Yellow, the latter three available from Allied Chemical Company, and the like. Typical pigments are carbon black, graphite, lamp black, bone black, charcoal, titanium dioxide, white lead, zinc oxide, zinc sulfide, iron oxide, chromium oxide, lead chromate, zinc chromate, cadmium yellow, cadmium red, red lead, antimony dioxide, magnesium silicate, calcium carbonate, calcium silicate, phthalocyanines, benzidines, naphytols, toluidines, and the like.

The liquid developer composition may comprise a finely divided opaque powder, a high resistance liquid and an ingredient to prevent agglomeration. Typical high resistance liquids include such organic dielectric liquids as Isopar, carbon tetrachloride, kerosene, benzene, trichloroethylene, and the like. Other liquid developer components or additives include vinyl resins, such as carboxy vinyl polymers, polyvinylpyrrolidones, methylvinylether maleic anhydride interpolymers, polyvinyl alcohols, cellulosics such as sodium carboxyethylcellulose, hydroxypropylmethyl cellulose, hydroxyethyl cellulose, methyl cellulose, cellulose derivatives such as esters and ethers thereof, alkali soluble proteins, casein, gelatin, and acrylate salts such as ammonium polyacrylate, sodium polyacrylate, and the like.

Any suitable conventional xerographic development technique may be utilized to deposit toner particles on the electrostatic latent image on the imaging surface of the dielectric imaging members of this invention. Well known xerographic development techniques include, magnetic brush, cascade, powder cloud, electrophoretic and the like development processes. Magnetic brush development is more fully described, for example, in U.S. Pat. No. 2,791,949, cascade development is more fully described, for example, in U.S. Pat. No. 2,618,551 and U.S. Pat. No. 2,618,552, powder cloud development is more fully described, for example, in U.S. Pat. No. 2,725,305 and U.S. Pat. No. 2,918,910, and U.S. Pat. No. 3,015,305, and liquid development is more fully described, for example, in U.S. Pat. No. 3,084,043. All of these toner, developer and development technique patents are incorporated herein in their entirety.

The deposited toner image may be transferred to a receiving member such as paper by any suitable technique conventionally used in xerography such as corona transfer, pressure transfer, adhesive transfer, bias roll transfer and the like. Typical corona transfer involves contacting the deposited toner particles with a sheet of paper and applying an electrostatic charge on the side of the sheet opposite to the toner particles. A single wire corotron having applied thereto a potential of between about 5000 and about 8000 volts provides satisfactory transfer.

After transfer, the transferred toner image may be fixed to the receiving sheet. The fixing step may be also identical to that conventionally used in xerographic imaging. Typical, well known xerographic fusing techniques include heated roll fusing, flash fusing, oven fusing, laminating, adhesive spray fixing, and the like.

Since the xeroprinting master produces identical successive images in precisely the same areas, it has not been found necessary to erase the electrostatic latent image between successive images. However, if desired, the master may optionally be erased by conventional xerographic erasing techniques. For example, uniform exposure of the xeroprinting master to a strong light will discharge both the image and non-image areas of the master. Typical light intensities useful for erasure range from about 10 times to about 300 times the light intensities used for the uniform exposure step. Another well known technique involves exposing the imaging surface to AC corona discharge to neutralize any residual charge on the master. Typical potentials applied to the corona wire of an AC corona erasing device may range from about 3 kilovolts and about 10 kilovolts.

If desired, the imaging surface of the xeroprinting master may be cleaned. Any suitable cleaning step that is conventionally used in xerographic imaging may be employed for cleaning the xeroprinting master of this invention. Typical, well known xerographic cleaning techniques include brush cleaning, blade cleaning, web cleaning, and the like.

After transfer of the deposited toner image from the master to a receiving member, the master may, with or without erase and cleaning steps, be cycled through additional uniform charging, uniform illumination, development and transfer steps to prepare additional imaged receiving members.

Unlike some conventional xeroprinting masters, the master utilized in the xeroprinting system of this invention can be uniformly charged to its full potential because the entire imaging surface is insulating (i.e. no insulating patterns on a metal conductor where fringing fields from the insulating areas repel incoming corona ions to the adjacent conductive areas). This yields electrostatic image of high contrast potential and high resolution on the master. Thus high quality prints having high contrast density and high resolution are obtained. The problems of low contrast potential and poor resolution of conventional prior art masters are, thus, overcome. In addition, unlike many prior art electronic and/or xerographic printing techniques employing a conventional photoreceptor, such as conventional laser xerography in which the imagewise exposure step must be repeated for each print, the imagewise exposure step need only performed once to produce the xeroprinting master of this invention from which multiple prints can be produced at high speed. Thus the xeroprinting system of this invention surmounts the fundamental electronic bandwidth problem which prevents a conventional xerographic approach to very high quality, high speed elcronic black-and-white or color printing. Thus, the combined capabilities of high photosensitivity, high quality and high printing speed at reasonable cost make the xeroprinting master and xeroprinting system of this invention suitable for both high quality color proofing and printing/duplicating applications. Compared with offset printing, the xeroprinting system of this invention offers the advantages of lower master costs (no need for separate lithographic intermediate and printing plates. Intermediates are needed in offset printing because the printing plates are not photosensitive enough to be imaged directly; instead, the print plates are contact exposed to the intermediate using strong UV light, and the chemically developed), totally dry (if heat development is used) and simple preparation with no effluents, improved printing stability and substantially shortened time and lower cost to obtain the first acceptable print. As a result, this eliminates the need of using totally different printing technologies for color proofing and printing as required by prior art tehniques and the end users can be reliably assured of the desired print quality before a large number of prints is made. Therefore, the xeroprinting master and xeroprinting system of this invention are not only practical but less costly than other known systems. By separating the film structure into different layers, the imaging member of the present invention allows maximum flexibility in selecting appropriate materials to maximize its mechanical, chemical, electrical, imaging and xeroprinting properties. The xeroprinting master of this invention is formed as a result of permanent structural changes in the migration marking material in the softenable layer without removal and disposal of any components from the softenable layer. In other words, because of its unique imaging characteristics, the xeroprinting master and xeroprinting system of this invention offers the combined advantages of simple fabrication, lower costs, high photosensitivity (laser sensitivity), dry, fast and simple master preparation with no effluents, high quality, high resolution and high printing speed. Therefore, applications for this xeroprinting system include various types of printing systems such as high quality color printing and proofing. In addition, because of its high photosensitivity and charge transport capability, the xeroprinting master precursor member of this invention can also be, simply used as a conventional photoreceptor in conventional xerography. Furthermore, since the visible image on the xeroprinting master has high optical contrast density, the xeroprinting master of this invention can substitute the conventional silver-halide film for use as an intermediate film to prepare conventional printing plates in offset printing in addition to being useful as a xeroprinting master.

If heat development is used, the master making process of the present invention is totally dry, exceedingly simple (merely corona charging, imagewise exposure and heat development) and can be accomplished in a matter of seconds. Thus it is possible to configure a master-maker to utilize this process which can function either as a stand-alone unit or which can easily be integrated into a xeroprinting press to form a self-contained fully automated printing system suitable for use even in office environments. Because the xeroprinting master precursor member exhibits high photosensitivity and high resolution, computer-driven electronic writing techniques such as laser scanning can be advantageously used to create high resolution image (line or pictorial) on the xeroprinting master for xeroprinting. Therefore in conjunction with its capabilities of high quality, high resolution and high printing speed, a xeroprinting system of the present invention can deliver the full advantages of computer technology from the digital file input (text editing, composition, pagination, image manipulations etc.) directly to the printing process to produce prints having high quality and high resolution at high speed.

The invention will now be described in detail with respect to specific preferred embodiments thereof, it being noted that these examples are intended to be illustrative only and are not intended to limit the scope of the present invention. Parts and percentages are by weight unless otherwise indicated.

EXAMPLE I

A xeroprinting master precursor member similar to that illustrated in FIG. 3 was prepared by dissolving about 15.0 percent by weight of a 80/20 mole percent copolymer of styrene and hexylmethacrylate, and about 4.8 percent by weight of N,N'-diphenyl-N,N'-bis(3''-methylphenyl)-(1,1'-biphenyl)-4,4'-diamine in about 80.2 percent by weight toluene based on the total weight of the solution. The resulting solution was applied by means of a No. 25 wire wound rod to a 12 inch wide 76 micrometer (3 mil) thick Mylar polyester film (available from E. I. DuPont de Nemours Co.) having a thin, semi-transparent aluminum coating. The deposited softenable layer was allowed to dry at about 110° C. for about 15 minutes. The thickness of the dried softenable layer was about 5 microns. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05-0.1 micrometer below the exposed surface of the copolymer was formed. The resulting xeroprinting master precursor member was thereafter imaged and developed by a heat processing technique comprising the steps of negative corotron charging to a surface potential of about −400 volts, exposing to activating radiation through a step-wedge and heating to about 115° C. for about 5 seconds on a hot plate in contact with the polyester. The resulting imaged migration imaging member exhibited an optically sign-retaining image of the original, excellent image quality, resolution in excess of 228 line pairs per millimeter, and a contrast density of about 1.25. $D_{max}$ was about 1.85 and the $D_{min}$ was about 0.6. It was also found that the $D_{min}$ was due to substantial migration and dispersion in depth of the selenium particles toward the aluminum coating in the $D_{min}$ regions of the image.

The xeroprinting master was then uniformly charged with positive corona charge to about +600 volts followed by a brief uniform flash exposure to 430 nanometer activating illumination of about 10 ergs/cm$^2$. The surface potential was about +50 volts in the $D_{max}$ region of the image and about +330 volts in the $D_{min}$ region thereby yielding an electrostatic contrast potential of about +270 volts. This resulting electrostatic latent image was then toned with negatively charged toner particles comprising carbon black pigmented styrene/butylmethacrylate resin having an average particle size of about 10 micrometers to form a deposited toner image. The deposited toner image was electrostatically transferred to a sheet of paper by corona charging the rear surface of the paper and the transferred toner image thereafter heat fused to yield a high quality print. The transferred prints exhibited a contrast density of about 1.1 and resolution in excess of 15 line pairs per millimeters.

EXAMPLE II

A xeroprinting master precursor member similar to that illustrated in FIG. 2 was prepared by hand coating, with a No. 4 wire wound rod, a thin adhesive layer of polyester (49000, available from E. I. DuPont de Nemours Co.) onto an aluminized polyester film having a thickness of about 76 micrometers (3 mils). The adhesive layer upon drying at 110° C. for about 5 minutes had a thickness of about 0.1 micrometer. A charge transport spacing layer was thereafter formed on the adhesive layer by dissolving about °percent by weight of a polycarbonate resin, and about 6 percent by weight of N,N'-diphenyl-N,N'-bis(3''-methylphenyl)-(1,1'-biphenyl)-4,4'-diamine in about 74 percent by weight methylene chloride solvent based on the total weight of the solution. After drying at 110° C. for about 15 minute, the charge transport spacing layer had a thickness of about 4 micrometers. An image forming softenable layer was then formed on the charge transport spacing layer by applying a coating mixture comprising about 15 percent by weight of a 80/20 mole percent copolymer of styrene and hexylmethacrylate, 3 percent by weight, N,N'-diphenyl-N,N'-bis(3''-methylphenyl)-(1,1'-biphenyl)-4,4'-diamine, in about 82 percent by weight toluene based on the total weight of the solution. After drying drying at 110° C. for about 15 minutes, the image forming softenable layer had a dried thickness of about 2 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed. A xeroprinting master was thereafter prepared with this xeroprinting master precursor member in the same manner as that described in Example I. An optically sign-retaining visible image having a contrast density of about 1.15 and resolution in excess of 228 line pairs per millimeter was obtained. This xeroprinting master was then uniformly charged with positive corona charging to a potential of about +700 volts and uniformly flash exposed to 400–700 nonometer white light of about 60 ergs/cm$^2$. The surface potential in the $D_{max}$ region of the image was about +50 volts and the surface potential in the $D_{min}$ region was about +400 volts to yield a contrast potential of about +350 volts. This resulting electrostatic latent image was then toned with negatively charged toner particles comprising carbon black pigmented styrene/butylmethacrylate resin having an average particle size of about 10 micrometers to form a deposited toner image. The deposited toner image was electrostatically transferred to a sheet of paper by corona charging the rear surface of the paper and the transferred toner image thereafter heat fused to yield a high quality print. The transferred prints exhibited a contrast density of about 1.1 and resolution in excess of 15 line pairs per millimeter.

EXAMPLE III

A xeroprinting master precursor member similar to that illustrated in FIG. 1 was prepared by coating with a No. 25 wire wound rod a charge transport spacing layer on an aluminized polyester film having a thickness of about 76 micrometers (3 mils), dissolving about 20 percent by weight of a styrene ethylacrylate acrylic acid resin (RP1215, available from Monsanto Co.), and about 6.8 percent by weight of N,N'-diphenyl-N,N'-bis(3''-methylphenyl)-(1,1'-biphenyl)-4,4'-diamine in about 73.2 percent by weight toluene based on the total weight of the solution. After drying at 110° C. for about 15 minute, the charge transport spacing layer had a thickness of about 6 micrometers. An image forming softenable layer was then formed on the charge transport spacing layer by applying a coating mixture comprising about 15 percent by weight of a 80/20 mole percent copolymer of styrene and ethylacrylate, 2.4 percent by weight N,N'-diphyenyl-N,N'-bis(3''-methylphenyl)-(1,1'-biphenyl)-4,4'-diamine, in about 50 percent by weight cyclohexane solvent and about 32 percent by weight toluene solvent based on the total weight of the solution. After drying drying at 110° C. for about 15 minutes,the image forming softenable layer had a thickness of about 2 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed. A xeroprinting master was thereafter prepared with this xeroprinting master precursor member in the same manner as that described in Example I. A sign-retaining visible image having a contrast density of about 1.2 and resolution in excess of 228 line pairs per millimeter was obtained. This xeroprinting master was then uniformly charged with positive corona charging to a potential of about +850 volts and uniformly flash exposed to 440 nanometer activating illumination of about 50 ergs/cm$^2$. The surface potential $D_{max}$ region of the image was about +98 volts and the surface potential in the $D_{min}$ region was about +498 volts to yield a contrast potential of about +400 volts. This resulting electrostatic latent image was then toned with negatively charged toner particles comprising carbon black pigmented styrene/butadiene resin having an average particle size of about 6 micrometers to form a deposited toner image. The deposited toner image was electrostatically transferred to a sheet of paper by corona charging the rear surface of the paper and the transferred toner image thereafter heat fused to yield a high quality print. The transferred prints exhibited a contrast density of about 1.1 and resolution in excess of 15 line pairs per millimeter.

EXAMPLE IV

A xeroprinting master precursor member similar to that illustrated in FIG. 3 was prepared by dissolving about 15 percent by weight of a 80/20 mole percent copolymer of styrene and hexylmethacrylate, and about 4.8 percent by weight of N,N'-diphenyl-N,N'-bis(3''-methylphenyl)-(1,1'-biphenyl)-4.4'-diamine in about 80.2 percent by weight toluene based on the total weight of the solution. The resulting solution was applied by means of a No. 10 wire wound rod to a 12 inch wide 76 micrometer (3 mil) thick Mylar polyester film (available from E. I. duPont de Nemours Co.) having a thin, semi-transparent aluminum coating. The deposited softenable layer was allowed to dry at about 110° C. for about 15 minutes. The thickness of the dried softenable layer was about 2 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed. The resulting xeroprinting master precursor member was thereafter imaged and developed by a heat processing technique comprising the steps of positive corotron charging to a surface potential of about +200 volts, exposing to activating radiation through a step-wedge, and heating to about 115° C. for about 3 seconds on a hot plate in contact with the polyester. The resulting imaged migration imaging member exhibited an optically sign-retaining image of the original, excellent image quality, resolution in excess of 228 line pairs per millimeter, and an optical contrast density of about 1.13. $D_{max}$ was about 1.85 and the $D_{min}$ was about 0.72. It was also found that the $D_{min}$ was due to substantial migration in depth of the selenium particles toward the aluminum coating in the $D_{min}$ regions of the image.

The xeroprinting master was then uniformly charged with positive corona charge to about +250 volts followed by a brief uniform flash exposure to about 440 nanometer activating illumination of about 10 ergs/cm$^2$. The surface potential was about +22 volts in the $D_{max}$ region of the image and about +142 volts in the $D_{min}$ region thereby yielding an electrostatic contrast potential of about +120 volts. This resulting electrostatic latent image was then toned with negatively charged toner particles comprising carbon black pigmented styrene/butadiene resin having an average particle size of about 6 micrometers to form a deposited toner image. The deposited toner image was electrostatically transferred to a sheet of paper by corona charging the rear surface of the paper and the transferred toner image thereafter heat fused. It was found that the transferred image exhibited poor quality and low print density because of its relatively low elctrostatic contrast potential (about 120 volts) of the electrostatic latent image.

EXAMPLE IV

A xeroprinting master precursor member similar to that illustrated in FIG. 3 but without charge transport molecule in the softenable layer was prepared by dissolving about 15 percent by weight of a 80/20 mole percent copolymer of styrene and hexylmethacrylate in about 85 percent by weight toluene based on the total weight of the solution. The resulting solution was applied by means of a No. 25 wire wound rod to a 12 inch wide, 76 micrometers (3 mil) thick Mylar polyester film (available from E. I. duPont de Nemours Co.) having a thin, semi-transparent aluminum coating. The deposited softenable layer was allowed to dry at about 110° C. for about 15 minutes. The thickness of the dried softenable layer was about 5 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenium was then applied by vacuum deposition in a vacuum chamber maintained at a vacuum of about $4\times10^{-4}$ Torr. The imaging member was then rapidly chilled to room temperature. A reddish monolayer of selenium particles having an average diameter of about 0.3 micrometer embedded about 0.05–0.1 micrometer below the exposed surface of the copolymer was formed. The resulting xeroprinting master precursor member was thereafter imaged and developed by heat processing techniques comprising the steps of positive corotron charging to a surface potential of about +400 volts, exposing to activating radiation through a step-wedge, and heating to about 115° C. for about 5 seconds on a hot plate in contact with the polyester. It was found that without charge transport molecule in the softenable layer, the resulting sign-reversed image exhibited an optical contrast density of only about 1.2. $D_{max}$ was about 1.8 and the $D_{min}$ was about 0.6. It was also found that the $D_{min}$ was due to substantial depthwise migration and dispersion of the selenium particles toward the substrate in the $D_{max}$ region of the image.

The imaged member was then uniformly charged with positive corona charge to about +550 volts followed by a brief uniform flash exposure to 440 nm activating illumination of about 10 ergs/cm$^2$. Since the surface potential was about +520 volts in both the $D_{max}$ and $D_{min}$ regions, no electrostatic image was obtained.

EXAMPLE VI

A xeroprinting master precursor member was prepared as described in Example III and overcoated with a water borne solution containing about 10 percent by weight of styrene-acrylic copolymer (Neocryl A-1054, available from Polyvinyl Chemical Industries) and about 0.03 percent by weight of polysiloxane resin (Byk 301, available from Byk-Mallinckodt). The dried overcoat had a thickness of about 1.5 micrometers. The resulting overcoated xeroprinting master precursor member was thereafter imaged and developed by heat processing technique comprising the steps of positive corotron charging to a surface potential of about +600 volts, exposing to activating radiation through a step-wedge, and heating to about 115° C. for about 5 seconds on a hot plate in contact with the polyester. The resulting imaged migration imaging member exhibited an optically sign-retaining image of the original, excellent image quality, resolution in excess of 228 line pairs per millimeter, and a constrast density of about 1.0. $D_{max}$ was about 1.75 and the $D_{min}$ was about 0.75. The imaged member exhibited excellent abrasion resistance when scraped with a finger nail. The overcoated imaging member also retained its integrity when subjected to a very severe adhesive tape test with Scotch brand "Magic" adhesive tape. It was also found that the $D_{min}$ was due to substantial migration and dispersion of the selenium particles toward the aluminum layer in the $D_{min}$ regions of the image.

The xeroprinting master was then uniformly charged with positive corona charge to about +800 volts followed by a brief uniform flash exposure to 400–700 nanometer white light of about 100 ergs/cm$^2$. The surface potential was about +120 volts in the $D_{max}$ region of the image and about +520 volts in the $D_{min}$ region thereby yielding an electrostatic contrast potential of about +400 volts. This resulting electrostatic latent image was then toned with negatively charged dry toner particles comprising styrene/butylmethacrylate resin having an average particle size of about 6 micrometers to form a deposited toner image. The deposited toner image was electrostatically transferred to a sheet of paper by corona charging the rear surface of the paper and the transferred toner image thereafter heat fused to yield a high quality print. The contrast density of the prints was about 1.3 and resolution was in excess of 15 line pairs per millimeter.

EXAMPLE VII

A xeroprinting master precursor member similar to that illustrated in FIG. 3 was prepared by dissolving about 15.0 percent by weight of a copolymer of styrene and ethylacrylate, and about 2.4 percent by weight of N,N'-diphenyl-N,N'-bis (3''-methylphenyl)-(1,1'-biphenyl)-4,4'-diamine in about 82.6 percent by weight toluene based on the total weight of the solution. The resulting solution was coated onto a 12 inch wide 76 micrometer (3 mil) thick Mylar polyester film (available from E. I. DuPont de Nemours Co.) having a thin, semi-transparent aluminum coating. The deposited softenable layer was allowed to dry at about 110° C. for about 15 minutes. The thickness of the dried softenable layer was about 3.5 micrometers. The temperature of the softenable layer was raised to about 115° C. to lower the viscosity of the exposed surface of the softenable layer to about $5\times10^3$ poises in preparation for the deposition of marking material. A thin layer of particulate vitreous selenuim was then applied by vacuum deposition in a vacuum chamber maintained at a vacuum of about $4\times10^{-4}$ Torr. The imaging member was then rapidly chilled at room temperature. A reddish monolayer of selenium particles having an average diameter of about 0.3 micrometer embedded about 0.05–0.1 micrometer below the exposed surface of the copolymer was formed. The resulting xeroprinting master precursor member was thereafter imaged and developed by a heat processing technique comprising the steps of corotron charging to a surface potential of about +400 volts, exposing to activating radiation through a stepwedge and heating to about 115° C. for about 5 seconds on a hot plate in contact with the polyester. The resulting imaged migration imaging member exhibited an optically sign-retaining image of the original, excellent image quality, resolution in excess of 228 line pairs per millimeter, and an optical contrast density of about 1.2 $D_{max}$ was about 1.8 and the $D_{min}$ was about 0.60. It was also found that the $D_{min}$ was due to substantial depthwise migration of the selenium particles toward the aluminum layer in the $D_{min}$ regions of the image.

The xeroprinting master was then uniformly charged with positive corona charge to about +500 volts followed by a brief uniform flash exposure to 400–700 nanometer activating illumination of about 40 ergs/cm$^2$. The surface potential was about +50 volts in the $D_{max}$ region of the image and about +300 volts in the $D_{min}$ region thereby yielding an electrostatic contrast potential of about +250 volts. This resulting electrostatic latent image was then toned with negatively charged liquid toner particles comprising carbon black pigmented polyethylene/acrylic acid resin having an average particle size of about 0.2 micrometers to form a deposited toner image. The deposited toner image was electrostatically transferred to a sheet of paper by corona charging the rear surface of the paper and the transferred toner image thereafter heat fused to yield a high quality print. The contrast density of the prints was about 1.9 and resolution in excess of 60 line pairs per millimeter.

EXAMPLE VIII

A xeroprinting master member similar to that in Example III was prepared. The xeroprinting master was uniformly charged with positive corona charge to about +700 volts followed by a brief uniform flash exposure to white light of 400 nm–700 nm and about 100 ergs/cm$^2$. The surface potential was about +50 volts in the $D_{max}$ region of the image and about +450 volts in the $D_{min}$ region thereby yielding an electrostatic contrast potential of about +400 volts. The electrostatic image was then erased by uniform strong illumination of white light 400–700 nanometer and about 1000 ergs/cm$^2$. The above uniform charging, uniform exposure and erasure steps were repeated 1000 times. It was found that the xeroprinting master member was stable and the cycle to cycle surface potentials of +50 volts in the $D_{max}$ region of the image and about +450 volts in the $D_{min}$ region remained essentially unchanged.

EXAMPLE IX

A xeroprinting master member similar to that in Example VIII was prepared. This xeroprinting master was then taped to a bare drum, replacing the original photoreceptor drum of an automatic copier. The xeroprinting master was then uniformly charged with positive corona charge to about +700 volts and uniformly exposed to flash illumination to form an electrostatic latent image was then toned with negatively charged toner particles comprising carbon black pigmented polyethylene/acrylic acid resin having an average particle size of about 0.2 micrometers to form a deposited toner image. The deposited toner image was electrostatically transferred to a sheet of paper by corona charging the rear surface of the paper and the transferred toner image thereafter heat fused to yield a high quality print. This xeroprinting process was repeated for at least 1000 times with very good results.

Other modifications of the present invention will occur to those skilled in the art based upon a reading of the present disclosure. These are intended to be included within the scope of this invention.

What is claimed is:

1. A process for preparing an imaging member comprising providing xeroprinting master precursor member comprising a substrate, an intermediate layer selected from the group consisting of an adhesive layer, a charge transport spacing layer and a combination of said adhesive layer and said charge transport charging layer, and an electrically insulating softenable layer on said substrate, said softenable layer comprising charge transport molecules and a fracturable layer of electrically photosensitive migration marking material located substantially at or near the surface of said softenable layer spaced from said substrate, said charge transport spacing layer and said softenable layer comprising charge transport molecules, said charge transport molecules being predominantly nonabsorbing in the spectral region at which said electrically photosensitive migration marking material photogenerates charge carriers, being capable of increasing charge injection from said electrically photosensitive migration marking material to said softenable layer, being capable of transporting charge to said substrate, and being dissolved or molecularly dispersed in said softenable layer; electrostatically charging said member; exposing said member to activating radiation in an imagewise pattern; and developing said member by decreasing the resistance to migration of marking material in depth in said softenable layer at least sufficient to allow migration of marking material whereby marking material struck by said activating radiation migrates toward said substrate in image configuration.

2. A process for preparing an imaging member comprising providing xeroprinting master precursor member comprising a substrate, an intermediate layer selected from the group consisting of an adhesive layer, a charge transport spacing layer and a combination of said adhesive layer and said charge transport spacing layer, and an electrically insulating softenable layer on said substrate, said softenable layer comprising charge transport molecules and a fracturable layer of electrically photosensitive migration marking material located substantially at or near the surface of said softenable layer spaced from said substrate, said charge transport spacing layer and said softenable layer comprising charge transport molecules, said charge transport molecules being predominantly nonabsorbing in the spectral region at which said electrically photosensitive migration marking material photogenerates charge carriers, being capable of increasing charge injection from said electrically photosensitive migration marking material to said softenable layer, being capable of transporting charge to said substrate, and being dissolved or molecularly dispersed in said softenable layer; electrostatically charging said member; exposing said member to activating radiation in an imagewise pattern; and developing said member by decreasing the resistance to migration of marking material in depth in said softenable layer at least sufficient to allow migration of marking material whereby marking material struck by said activating radiation migrates toward said substrate in image configuration, wherein said marking material struck by said activating radiation migrates toward said substrate in image configuration to form the $D_{min}$ areas of said softenable layer.

3. A process for preparing an imaging member comprising providing xeroprinting master precursor member comprising a substrate, an intermediate layer selected from the group consisting of an adhesive layer, a charge transport spacing layer and a combination of said adhesive layer and said charge transport spacing layer, and an electrically insulating softenable layer on said substrate, said softenable layer comprising charge transport molecules and a fracturable layer of electrically photosensitive migration marking material located substantially at or near the surface of said softenable layer spaced from said substrate, said charge transport spacing layer and said softenable layer comprising charge transport molecules, said charge transport molecules being predominantly nonabsorbing in the spectral region at which said electrically photosensitive migration marking material photogenerates charge carriers, being capable of increasing charge injection from said electrically photosensitive migration marking material to said softenable layer, being capable of transporting charge to said substrate, and being dissolved or molecularly dispersed in said softenable layer; electrostatically charging said member; exposing said member to activating radiation in an imagewise pattern; and developing said member by decreasing the resistance to migration of marking material in depth in said softenable layer at least sufficient to allow migration of marking material whereby marking material struck by said activating radiation migrates toward said substrate in image configuration, wherein said migration marking material in areas of said softenable layer corresponding to said imagewise pattern which escaped exposure to said activating radiation form the $D_{max}$ areas in areas of said softenable layer.

4. A process for preparing an imaging member in accordance with claim 1 including decreasing said resistance to migration of marking material in depth in said softenable layer by heat softening said softenable layer.

5. A process for preparing an imaging member in accordance with claim 4 including exposing said softenable layer to solvent vapor prior to said charging of said member.

6. A process for preparing an imaging member in accordance with claim 1 including decreasing said resistance to migration of marking material in depth in said softenable layer by solvent softening said softenable layer.

7. A process for preparing an imaging member in accordance with claim 6 wherein said solvent is a vapor.

8. A process for preparing an imaging member in accordance with claim 1 wherein said fracturable layer is a monolayer.

9. A process for preparing an imaging member in accordance with claim 1 wherein said xeroprinting master member includes a protective overcoating comprising a film forming resin on said softenable layer.

10. An imaging member comprising a substrate, an intermediate layer selected from the group consisting of an adhesive layer, a charge transport spacing layer and a combination of said adhesive layer and said charge transport spacing layer, an electrically insulating softenable layer having an imaging surface overlying said substrate, said charge transport spacing layer comprising charge transport molecules, said electrically insulating softenable layer comprising charge transport molecules and in at least one region of said electrically insulating layer a fracturable layaer of closely spaced electrically photosensitive migration marking particles in an imagewise pattern located substantially at or near said imaging surface of said electrically insulating layer, said imagewise pattern being capable of substantial photodischarge upon electrostatic charging and exposure to activating radiation and being substantially absorbing and opaque to activating radiation in the spectral region where the photosensitive migration marking particles photogenerate charges, and in at least one other region of said electrically insulating layer electrically photosensitive migration marking particles dispersed in depth within said electrically insulating layer in a pattern adjacent to and complementary with said imagewise pattern of said closely spaced electrically photosensitive migration marking particles, said pattern of said dispersed in depth electrically photosensitive migration marking particles being capable of retaining substantial charge upon charging and exposure to activating radiation and being substantially less absorbing to activating radiation in the spectral region where the photosensitive migration marking particles photogenerate charges, said pattern of said dispersed in depth electrically photosensitive migration marking particles having substantially the same particle size as the particle size of said closely spaced electrically photosensitive migration marking particles in said fracturable layer, said charge transport molecule being being capable of increasing charge injection from said electrically photosensitive migration marking material to said electrically insulating layer, being capable of transporting charge to the said substrate and being dissolved or molecularly dispersed in said layer.

11. A xeroprinting process comprising providing a xeroprinting master comprising a substrate, and an electrically insulating softenable layer having an imaging surface overlying said substrate, said electrically insulating softenable layer comprising charge transport molecules and in at least one region of said electrically insulating layer a fracturable layer of closely spaced electrically photosensitive migration marking particles in an imagewise pattern located substantially at or near said imaging surface of said electrically insulating layer, said imagewise pattern being capable of substantial photodischarge upon electrostatic charging and exposure to activating radiation and being substantially absorbing and opaque to activating radiation in the spectral region where the photosensitive migration marking particles photogenerate charges, and in at least one other region of said electrically insulating layer electrically photosensitive migration marking particles dispersed in depth within said electrically insulating layer in a pattern adjacent to and complementary with said imagewise pattern of said closely spaced electrically photosensitive migration marking particles, said pattern of said dispersed in depth electrically photosensitive migration marking particles being capable of retaining substantial charge upon charging and exposure to activating radiation and being substantially less absorbing to activating radiation in the spectral region where the photosensitive migration marking particles photogenerate charges, said pattern of said dispersed in depth electrically photosensitive migration marking particles having substantially the same particle size as the particle size of said closely spaced electrically photosensitive migration marking particles in said fracturable layer, said charge transport molecule being capable of increasing charge injection from said electrically photosensitive migration marking material to said electrically insulating layer, being capable of transporting charge to the said substrate and being dissolved or molecularly dispersed in said layer; uniformly exposing said electrically insulating softenable layer to electromagnetic radiation to substantially discharge said imaging surface overlying said imagewise pattern of said closely spaced electrically photosensitive migration marking particles and to form an electrostatic latent image on the areas of said imaging surface overlying the complementary pattern of said layer of dispersed in depth electrically photosenstivie migration marking particles; developing said imaging surface with electrostatically attractable toner particles to form a toner image corresponding to said imagewise pattern or said complementary pattern; and transferring said toner image to a receiving member.

12. A xeroprinting process in accordance to claim 11 wherein said charge transport molecule comprising a substituted, unsymmetrical tertiary amine is one having the general formula:

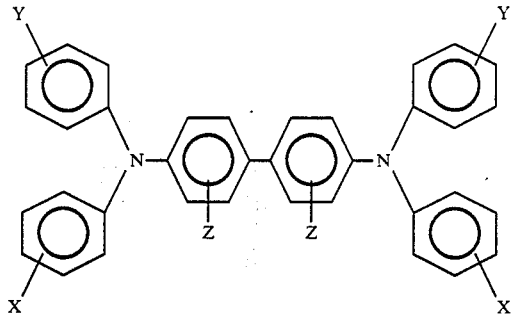

wherein X, Y and Z are selected from the group consisting of hydrogen, an alkyl group having from 1 to about 20 carbon atoms and chlorine and at least one of X, Y and Z is independently selected to be an alkyl group having from 1 to about 20 carbon atoms or chlorine.

13. A xeroprinting process in accordance to claim 11 wherein said member comprises a charge transport spacing layer between said substrate and said softenable layer, said charge transport spacing layer comprising a charge transport compound and a film forming binder.

14. A xeroprinting process in accordance to claim 13 wherein said charge transport spacing layer has a thickness of between about 1 micrometer and about 25 micrometers.

15. A xeroprinting process in accordance to claim 13 wherein the concentration of said transport compound in said charge transport spacing layer is between about 10 percent and about 50 percent by weight based on the total weight of said charge transport spacing layer.

16. A xeroprinting process in accordance to claim 13 wherein the concentration of said charge transport compound in said softenable layer is between about 8 percent and about 50 percent by weight based on the total weight of said softenable layer.

17. A xeroprinting process in accordance to claim 11 wherein said softenable layer has a thickness of between about 3 micrometers and about 25 micrometers.

18. A xeroprinting process in accordance to claim 11 wherein the background potential of said region of said electrically insulating layer containing said fracturable layer of closely spaced electrically photosensitive migration marking particles in an imagewise pattern located substantially at or near said imaging surface of said electrically insulating layer and the background potential of said other region of said electrically insulating layer containing said dispersed and migrated electrically photosensitive migration marking particles differ by at least about 30 percent of the applied surface potential after said uniform electrostatic charge is deposited on said imaging surface of said xeroprinting master and said electrically insulating softenable layer is uniformly exposed to said electomagnetic radiation.

* * * * *